United States Patent [19]

Ono

[11] 3,960,569

[45] June 1, 1976

[54] DIFFUSION TRANSFER COLOR FILM UNIT WITH HYDROXY SUBSTITUTED ALKYLENE AMINO DEVELOPMENT ACCELERATORS

[75] Inventor: Yoshiaki Ono, Minami-ashigara, Japan

[73] Assignee: Fuji Photo Film Co., Ltd., Minami-ashigara, Japan

[22] Filed: Nov. 20, 1974

[21] Appl. No.: 525,431

[30] Foreign Application Priority Data

Nov. 20, 1973 Japan ..... 48-130379

[52] U.S. Cl. ..... 96/77; 96/3; 96/29 D; 96/55; 96/66.3; 96/76 R

[51] Int. Cl.[2] ..... G03C 1/40; G03C 7/00; G03C 5/54; G03C 1/48

[58] Field of Search ..... 96/3, 29 D, 77, 55, 96/66.3, 95, 107

[56] References Cited

UNITED STATES PATENTS

| | | | |
|---|---|---|---|
| 2,191,037 | 2/1940 | Mannes et al. | 96/55 |
| 2,518,698 | 8/1950 | Lowe et al. | 96/107 |
| 3,128,182 | 4/1964 | Bard et al. | 96/66.3 |
| 3,128,183 | 4/1964 | Jones et al. | 96/3 |
| 3,443,940 | 5/1969 | Bloom et al. | 96/77 |
| 3,502,472 | 3/1970 | Willems et al. | 96/95 |
| 3,647,436 | 3/1972 | Bush | 96/77 |
| 3,749,578 | 7/1973 | Ohkubo et al. | 96/76 R |

FOREIGN PATENTS OR APPLICATIONS

| | | |
|---|---|---|
| 904,364 | 9/1958 | United Kingdom |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A diffusion transfer color film unit which comprises:

1. a light-sensitive element comprising a support having thereon at least one light-sensitive layer unit comprising (i) a negative-type light-sensitive silver halide emulsion layer containing a ballasted compound capable of reacting with an oxidation product of an aromatic primary amino color developing agent to provide a non-diffusible compound and (ii) an adjacent layer containing physical development nuclei and a ballasted coupler capable of reacting with an oxidation product of an aromatic primary amino color developing agent to provide a diffusible dye;
2. an image-receiving element;
3. a rupturable container which retains an alkaline processing composition;
4. an aromatic primary amino color developing agent or a precursor thereof and a solvent for silver halide;

and at least one compound represented by the following general formula (I)

$$NH_2-R_1-\overset{\overset{R_3}{|}}{N}-R_2-OH \qquad (I)$$

wherein $R_1$ and $R_2$ each represents an alkylene group having 1 to 4 carbon atoms; and $R_3$ represents a hydrogen atom, an amino group, an alkyl group having 1 to 4 carbon atoms or an aminoalkyl group having 1 to 4 carbon atoms; or represented by the following general formula (II)

$$NH_2-R_4-\underset{\underset{OH}{|}}{\overset{\overset{R_6}{|}}{C}}-R_5-NH_2 \qquad (II)$$

wherein $R_4$ and $R_5$ each represents an alkylene group having 1 to 4 carbon atoms; and $R_6$ represents a hydrogen atom, an amino group, an alkyl group having 1 to 4 carbon atoms or an aminoalkyl group having 1 to 4 carbon atoms.

27 Claims, 5 Drawing Figures

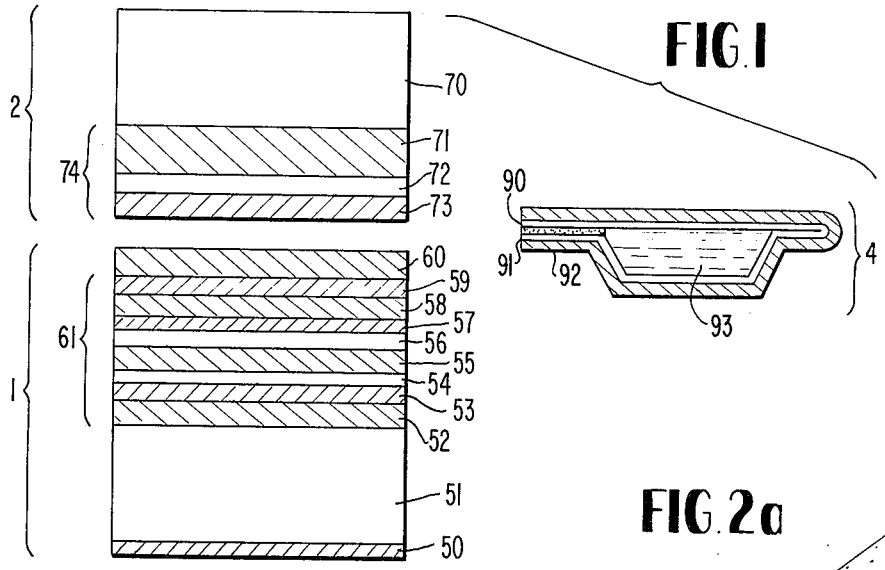
FIG. 1
FIG. 2a
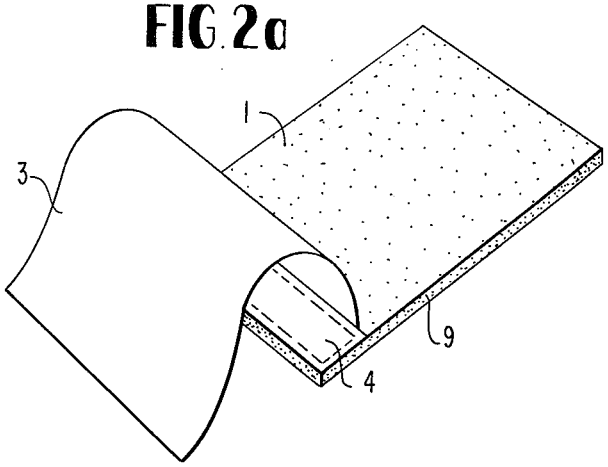
FIG. 2b
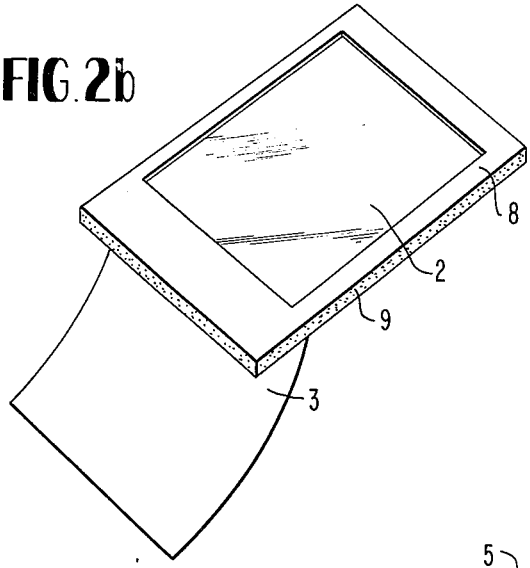
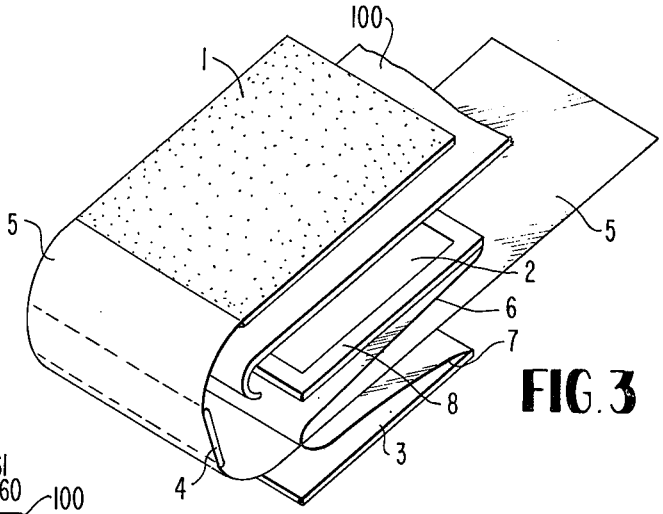
FIG. 3
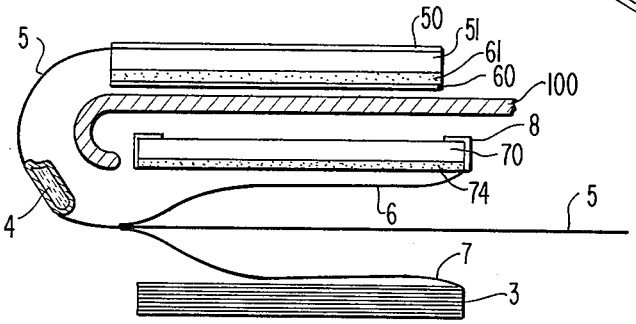
FIG. 4

DIFFUSION TRANSFER COLOR FILM UNIT WITH HYDROXY SUBSTITUTED ALKYLENE AMINO DEVELOPMENT ACCELERATORS

BACKGROUND OF THE INVENTION

1. Field of the Invention

The present invention relates to a method for rapidly obtaining a diffusion transfer color image with high contrast using a dissolution-physical development system.

2. Description of the Prior Art

The so-called diffusion transfer color photographic method, in which a silver halide emulsion layer is used as a light-sensitive element and an imagewise distribution of diffusible dye image-forming materials such as diffusible dyes formed as a result of the development of the exposed silver halide emulsion layer is allowed to diffuse into another layer and fixed there to form transferred dye images is well-known.

In this photographic method, since the transferred dye images are formed in a layer different from the silver halide emulsion layer, it is not necessary to remove remaining silver halide and silver deposited by fixing, bleaching or like steps. Therefore, dye images can be obtained in only one development. Furthermore, techniques are known in which a film unit having associated therewith a development processing solution is used and, immediately after photographing, the development processing starts in a camera to rapidly provide dye images. Among these techniques, a unified film unit which permits sequential observation of image formation while it is processed in a bright place outside a camera and which does not require operations such as delamination of the print layer from the film unit, has been newly developed.

In particular, a method for obtaining a transferred dye image by using an aromatic primary amino color developing agent and a ballasted coupler capable of coupling with an oxidation product of the color developing agent, and several chemical means for obtaining a positive image distribution of diffusible dyes by using a negative-type silver halide emulsion as a light-sensitive element are known. Still further, the transfer of dye images from a light-sensitive element comprising a support having superposed thereon a plurality of emulsion layers having associated therewith diffusible dye-providing materials for subtractive color reproduction, to a common image-receiving layer is also known. In these reversal color units, some type of image-reversing optical mechanism is necessary for obtaining a color image corresponding to a photographed object.

The present invention comprises a film unit having this image-reversing mechanism using a dissolution-physical development system.

The dissolution-physical development system is briefly described below.

In the diffusion transfer color unit using the dissolution-physical development system, (i) a negative-type silver halide emulsion layer containing a ballasted compound capable of reacting with an oxidation product of an aromatic primary amino color developer to provide a non-diffusible compound; (ii) a light-insensitive layer adjacent the silver halide emulsion layer, containing a ballasted coupler and physical development nuclei, with the ballasted coupler being capable of reacting with an oxidation product of the developer to provide a diffusible dye; and (iii) an aromatic primary amino color developer as a processing solution or a precursor thereof in a light-sensitive element and a solvent for silver halide, the precursor being capable of providing the developer as a result of hydrolysis with a processing composition; are required.

This dissolution-physical development system has long been known. However, this system has been quite impractical due to the low sensitivity, a large amount of stain, low contrast, slow color-developing rate and the like.

In the inversion of images according to the dissolution-physical development system, imagewise exposed silver halide is developed, a solvent for silver halide dissolves, after the completion of this negative development, the silver halide located at the unexposed areas to form a silver complex salt, this complex salt diffuses into an adjacent layer containing both physical development nuclei and a ballasted coupler capable of releasing a diffusible dye, physical development imagewise occurs with the help of an aromatic primary amino color developing agent and an alkali contained in a processing solution composition, and an oxidized product of the aromatic primary amino color developing agent reacts with a ballasted coupler to release a diffusible dye with a positive image distribution. At this occasion, it is desirable to cause the negative development of the imagewise exposed silver halide as rapidly as possible and to rapidly form, after the completion of the negative development, the silver halide complex salt located at the unexposed areas with a solvent for silver halide and rapidly diffuse into an adjacent layer containing physical development nuclei. Also, in order to obtain an instant photograph in a short time, it is desirable for the diffused silver complex salt to rapidly liberate a diffusible dye with a positive image distribution with the help of physical development nuclei, a ballasted coupler capable of reacting with an aromatic primary amino color developing agent to release a diffusible dye, an alkali in a processing solution and an aromatic primary amino color developing agent, thus rapidly releasing a diffusible dye with a positive image distribution. if a solvent for silver halide acts before the completion of the negative development due to the slow rate of the negative development, even silver halide located at the exposed areas is also dissolved and diffused into a positive layer and physical development takes place in the positive layer. Thus, the density at the areas corresponding to the highlight areas of the positive image is increased so much that the resulting positive dye image formed as a result of diffusion and fixation in the image-receiving layer possesses stains to a great extent and is non-contrasty and indistinct.

However, with a conventionally known development-processing solution having the following composition;

| Development-Processing Solution | | |
|---|---|---|
| Ascorbic Acid | 0.2 | g |
| 4-Amino-N-ethyl-N-(β-hydroxyethyl)-aniline Sulfate | 35 | g |
| 6-Nitrobenzimidazole | 0.2 | g |
| Sodium Hydroxide | 35 | g |
| Carboxymethyl Cellulose | 20 | g |
| Sodium Thiosulfate | 8 | g |
| Titanium Dioxide | 25 | g |
| Water to make | 1 | l |

a silver-complexing agent acts before the silver halide is completely negative-developed, and hence the agent acts not only on the silver halide located at the unexposed areas to form a silver complex salt but also on the silver halide located at the exposed areas to similarly form a silver complex salt, the complex salt diffusing into a physical development nuclei-containing layer. Thus, a positive image poor in clearing of the highlight areas results. In such a case, the resulting positive image exhibits a characteristic curve in which the minimum density (Dmin) at a toe area is high and both the sensitivity and contrast are low. Therefore, only an unsatisfactory image of low practical value can be obtained. This characteristic cannot be markedly improved by changing the amount of developing agent or silver-complexing agent. For example, even when negative development occurs much more rapidly to complete the negative development prior to the action of the complexing agent in an attempt to shorten the processing time or reduce the Dmin of the positive image for obtaining a distinct image, there is a limit to the concentration of the alkali and the developing agent. Because, when an alkali and a developing agent such as 4-amino-N-ethyl-N-(β-hydroxyethyl)aniline sulfate or 4-amino-3-methyl-N-ethyl-N-(β-hydroxyethyl)aniline sulfate (monohydrate) is concentrated to the degree of about 50 g/l, the difficulty occurs that the sulfuric acid used as the salt-forming agent for the developing agent is liberated to precipitate oil droplets of free 4-amino-N-ethyl-N-(β-hydroxyethyl)aniline. This processing solution must be retained in a rupturable container and must be unified with a film unit so that a number of film units can be stacked as compactly as possible in a film cassette for use in a camera. Therefore, the amount of the processing solution used must be as small as possible. Otherwise, a thick film cassette would be necesary, resulting in the production of a compact camera being impossible. Also, if a processing solution with low developing power must be spread thickly, the amount of water necessarily becomes great, and hence a thickening agent must be used in a large amount. If the thickening agent is spread in a large amount, the rate of diffusion of a diffusible dye into an image-receiving layer is seriously retarded, resulting in seriously deteriorating the rapid property which is essential for instant color photography. Thus, such means are not preferred.

SUMMARY OF THE INVENTION

An object of the present invention is to accelerate the progress of developing a negative emulsion and to increase the rate of dissolving silver halide by a solvent for silver halide, by adding the compound of the present invention to a development-processing solution, and to accelerate the rate at which a diffusible dye released from a positive layer is diffused into and fixed in an image-receiving layer, by increasing the activity of a developer and making the necessary thickness of a processing solution as thin as possible and reducing the amount of a thickening agent used. These are necessary for attaining color diffusion transfer with rapidity and high sensitivity.

Another object of the present invention is to markedly reduce the undeveloped silver halide grains at the exposed areas (so-called "dead grains"). This can be attained by adding the compound of the present invention, whereby the rate of developing a negative emulsion is enhanced.

A solvent for silver halide such as sodium thiosulfate dissolves even these dead grains to form a silver complex salt, which salt then moves into a positive layer (a layer containing physical development nuclei and a ballasted coupler capable of releasing a diffusible dye) and causes physical development to form a dye. This dye is then diffused into an image-receiving layer and fixed there. Thus, a positive image with a serious amount of stain is formed. Therefore, it is necessary to effect development as strongly as possible so as to remove these dead grains.

As is described above, a further object of the present invention is to prevent silver halide at the exposed areas from being dissolved prior to development to diffuse into a positive layer (a layer containing physical development nuclei and a ballasted coupler capable of releasing a diffusible dye). Such diffusion at the exposed areas would result in unfavorable physical development occurring and in releasing a diffusible dye which would diffuse into an image-receiving layer and be fixed there to form a large amount of stain. This object is attained by accelerating the negative development of the exposed areas, whereby a solvent for silver halide is allowed to act after the completion of the negative development.

As a result of extensive investigations to attain the above-described objects, the present invention has been achieved.

That is, the present invention comprises a diffusion transfer color film unit of the dissolution-physical development system, A. which comprises:

1. a light-sensitive element comprising a support having thereon at least one light-sensitive layer unit comprising (i) a negative-type silver halide emulsion layer containing a ballasted compound capable of reacting with an oxidation product of an aromatic primary amino color developing agent to provide a nondiffusible compound and (ii) an adjacent layer containing physical development nuclei and a ballasted coupler capable of reacting with an oxidation product of an aromatic primary amino color developing agent to provide a diffusible dye;
2. an image-receiving element comprising a support having thereon an image-receiving layer capable of fixing diffusible dyes released from the light-sensitive element;
3. a rupturable container which retains an alkaline processing composition and capable of releasing the contents by the action of pressure-applying members; and
4. an aromatic primary amino color developing agent in the processing composition or a precursor thereof which provides, upon hydrolysis with the processing composition, the aromatic primary amino color developing agent in the light-sensitive element, and a solvent for silver halide and B. which is adapted to be processed, after imagewise exposure of the light-sensitive element, by spreading the processing composition in a layer form between the light-sensitive element and the image-receiving element through the action of pressure-applying members, the diffusion transfer color film unit containing at least one compound represented by the following general formula (I) or (II);

$$NH_2-R_1-\overset{\overset{\displaystyle R_3}{|}}{N}-R_2-OH \qquad (I)$$

wherein $R_1$ and $R_2$ each represents an alkylene group having 1 to 4 carbon atoms; and $R_3$ represents a hydrogen atom, an amino group, an alkyl group having 1 to 4 carbon atoms or an aminoalkyl group having 1 to 4 carbon atoms; and

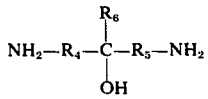

(II)

wherein $R_4$ and $R_5$ each represents an alkylene group having 1 to 4 carbon atoms; and $R_6$ represents a hydrogen atom, an amino group, an alkyl group having 1 to 4 carbon atoms or an aminoalkyl group having 1 to 4 carbon atoms.

BRIEF DESCRIPTION OF THE DRAWINGS

FIG. 1 is a cross sectional view showing a light-sensitive element, a image-receiving element and a processing composition container which can be used in the present invention.

FIG. 2 is a perspective view of one embodiment of a film unit of the present invention, wherein FIG. 2*a* is as viewed from the light-sensitive element side and FIG. 2*b* is as viewed from the image-receiving element side.

FIG. 3 is a perspective view of another embodiment of the film unit of the present invention.

FIG. 4 is a cross sectional view of the film unit illustrated in FIG. 3.

DETAILED DESCRIPTION OF THE INVENTION

In the above-described general formulae (I) and (II), examples of alkylene groups having 1 to 4 carbon atoms represented by $R_1$, $R_2$, $R_4$ and $R_5$ include, e.g., a methylene group, an ethylene group, a trimethylene group, a propylene group, a tetramethylene group, a 1,1-dimethylethylene group, a 2-methyltrimethylene group, etc. Examples of alkyl groups having 1 to 4 carbon atoms represented by $R_3$ and $R_6$ include, e.g., a methyl group, an ethyl group, a propyl group, an isopropyl group, a butyl group, a secbutyl group, a t-butyl group, etc. Suitable aminoalkyl groups having 1 to 4 carbon atoms represented by $R_3$ and $R_6$ are, e.g., an aminomethyl group, an aminoethyl group, an aminopropyl group, an aminobutyl group, etc.

Several specific examples of the compound of the present invention are illustrated below.

(1) $NH_2CH_2NHCH_2OH$ (2) $NH_2CH_2NHCH_2CH_2OH$ (3) $NH_2CH_2CH_2NHCH_2OH$ (4) $NH_2CH_2CH_2NHCH_2CH_2OH$ (5) $NH_2CH_2CH_2CH_2NHCH_2CH_2OH$ (6) $NH_2CH_2CH_2NHCH_2CH_2CH_2OH$ (7) $NH_2CH_2CH_2NHCH(CH_3)CH_2OH$ (8) $NH_2CH_2CH_2NHCH_2C(CH_3)_2-OH$ (9) $NH_2CH_2CH_2NHCH_2CH(OH)CH_3$

(10) $NH_2CH_2CH_2CH_2CH_2NHCH_2CH_2OH$

(11) $NH_2CH_2CH_2NHCH_2CH_2CH_2CH_2OH$

(12) $NH_2CH_2CH_2NHCH_2CH(CH_3)CH_2OH$

(13) $NH_2CH_2CH_2N(CH_3)-CH_2CH_2OH$

(14) $NH_2CH_2CH_2N(NH_2)-CH_2-CH_2OH$

(15) $NH_2CH_2CH_2N(NH_2)-CH_2-CH(CH_3)-CH_2OH$

(16) $NH_2CH_2CH_2N(CH_2CH_2NH_2)CH_2CH_2OH$

(17) $NH_2CH_2CH(OH)-CH_2NH_2$

(18) $NH_2CH_2CH_2CH(OH)CH_2NH_2$

(19) $NH_2CH_2CH_2CH(OH)CH_2CH_2NH_2$

(20) $NH_2CH_2CH_2CH(OH)CH_2CH_2CH_2NH_2$

(21) $NH_2CH_2CH_2CH(OH)CH_2CH(CH_3)CH_2NH_2$

(22) $NH_2CH_2C(CH_3)(OH)CH_2NH_2$

(23) $NH_2CH_2CH_2-C(CH_3)(OH)-CH_2NH_2$

(24) $NH_2CH_2C(NH_2)(OH)-CH_2NH_2$

(25) $NH_2CH_2CH_2C(NH_2)(OH)CH_2NH_2$

(26) $NH_2CH_2C(CH_2NH_2)(OH)CH_2NH_2$

(27) $NH_2CH_2C(CH_2CH_2NH_2)(OH)CH_2NH_2$

(28) $NH_2CH_2CH_2C(CH_2NH_2)(OH)CH_2NH_2$

(29) $NH_2CH_2CH_2C(CH_2CH_2NH_2)(OH)CH_2NH_2$

(30) $NH_2CH_2CH_2CH_2C(CH_2NH_2)(OH)-CH_2NH_2$

The course of the use of the development accelerator in accordance with the present invention is as follows.

i. The light-sensitive element is imagewise exposed in a camera either directly from the opposite side to the support side or through the transparent support from the support side.

ii. A processing composition is spread between the light-sensitive element and an image-receiving element in a layer form by applying a pressure to a processing composition container through pressure-applying members to rupture it, with the surfaces opposite to the supports of the two elements being disposed in a face-to-face contact with each other.

iii. Each light-sensitive silver halide emulsion layer of each light-sensitive layer unit is developed in accordance with the exposure amount by the action of the development accelerator of the present invention, an alkali and an aromatic primary amino color developing agent (or the same developing agent released from a precursor contained in the light-sensitive element due to hydrolysis with the alkali), with the development accelerator, alkali and developing agent being introduced by the processing composition. At this occasion, the development is of a negative type. With the reduction of the silver halide contained in the light-sensitive emulsion layer, the color developing agent is oxidized and reacts with a ballasted coupler within the light-sensitive emulsion layer to provide non-diffusible dyes.

iv. On the other hand, the silver halide in the light-sensitive emulsion layer at the unexposed areas is dissolved by the action of a silver-complexing agent such as sodium thiosulfate and the thus formed complex salt diffuses into an adjacent layer containing fine physical development nuclei and a non-diffusible coupler capable of producing a diffusible dye. Examples of physical development nuclei include nuclei of noble metals such as silver, platinum, palladium, gold, rhodium, ruthenium, osmium, etc., as disclosed in U.S. Pat. No. 3,647,440 and silver sulfide, palladium sulfide, gold sulfide and the like. The silver complex salt, diffused from the light-sensitive emulsion layer, rapidly undergoes physical development with the help of an alkali, an aromatic primary amino color developing agent (or the same developing agent released from a precursor contained in the light-sensitive element due to hydrolysis with the alkali), physical development nuclei, the development accelerator of the present invention and a color coupler. This physical development is accompanied by the oxidative coupling reaction between the ballasted coupler contained in the light-insensitive layer and an aromatic primary amino developing agent, thus a diffusible dye being released with a positive image distribution. The diffusible dyes released from each light-sensitive layer unit diffuse through the light-sensitive element and through the processing solution layer and reach the image-receiving layer, where they are fixed to form a positive dye image.

v. At the substantial completion of the desired dye image transfer, the development in the light-sensitive element is discontinued due to the exhaustion of effective ingredients contained in the processing composition or by means of a timing mechanism for stopping development, with this timing mechanism being contained in the film unit.

vi. The light-sensitive element is separated from the image-receiving element depending upon the purpose of the end use of the film unit. The light-sensitive element is sometimes utilized after being subjected to a silver-removing processing or the like.

The compound of the present invention is effective when added in an amount of about 0.05 g to 5 g per liter of the processing solution. If the amount of the compound of the present invention is less than about 0.05 g, the effect of improving the contrast of the positive image is low, while, if more than about 5 g of the compound of the present invention is present the fog of a negative emulsion increases and the Dmin of a positive image is increased, with the Dmax being reduced, reducing the difference between the Dmax and the Dmin ($\Delta D$) in the positive image and resulting in an image having low contrast. Therefore, a preferred amount of the compound of this invention added is 0.05 to 3 g per liter of a processing solution.

Additionally, when the compound of the present invention is directly added to an emulsion, similar effects can be obtained. However, it is more advantageous to add the compound to a processing solution from the viewpoint of influence on the stability of a light-sensitive material with the lapse of time.

Also, as a result of comparing the compound of the present invention with various sensitizing agents thus far known for black-and-white or conventional color photography, the conventional compounds were found to be ineffective for the dissolution-physical development system. For example, with Metol, hydroquinone, alkyl-substituted hydroquinone derivatives, p-aminophenol, phenidone, glycine, 2,4-diaminophenol, hydroxylamine hydrochloride, polyoxyethylene glycol (M. W. = about 1,500), semicarbazide hydrochloride, etc., it is true that the rate of negative development is raised, but the Dmax of the positive image is reduced so seriously that they cannot be employed practically with a diffusion transfer color material using the dissolution-physical development system. The reason for the great difference between the effect of these sensitizers when applied to black-and-white or conventional color systems and the effect thereof when applied to the dissolution-physical development system is that, in the dissolution-physical development system, the light-sensitive materials contains fine nuclei (of a size of about 0.002 $\mu$ to 0.02 $\mu$) of a heavy metal and the processing solution contains a solvent for silver halide (a complexing agent). These factors require an additional consideration not required with the black-and-white or conventional color systems. That is, the effect of the sensitizer is influenced by complicated factors before the formation of a positive image, such as the dissolving rate of silver halide, the diffusion rate of the silver complex into a positive layer, the stability of the silver complex and the activity of physical development nuclei, which is different from the black-and-white and conventional color systems.

That is, the rate of dissolving the silver halide must be so adjusted that dissolution of silver halide does not precede the negative development, and the silver complex salt must possess a staability such that it is stable until the silver complex salt reaches the positive nuclei-containing layer (physical development nuclei-containing layer) and is decomposed as fast as possible in the vicinity of the nuclei contained in the positive nuclei-containing layer. Also, the activity of the physical development nuclei is not at presently clearly understood. Phenomenally, the silver complex salt is decomposed in the presence of a developing agent, an alkali and developing nuclei, silver is deposited on the nuclei and, in this occasion, an oxidation-reduction reaction occurs between the silver complex and the developing agent in which the oxidized developing agent reacts with a coupler to release a diffusible dye. It is certain that the rate of color development and the color density due to this physical development in this occasion greatly depend upon the activity of the physical development nuclei. The particle size, the surface area and the kind of the physical development nuclei are important factors. The aforesaid conventional sensitizers can reduce the activity of the physical development nuclei due to adsorption on them, or they may have a poor ability for accelerating dissolution of the silver halide as well as a poor ability for accelerating the negative development.

The compound of the present invention is an excellent additive for a processing solution in accordance with the dissolution-physical development system, which can accelerate the negative development and, at the same time, increase the rate of positive color development.

Of the conventionally known compounds analogous to the compound of the present invention, diethanolamine and triethanolamine, which are known as sensitizers for black-and-white and conventional color systems, exhibit no effects on accelerating development and no effects on improving contrast when applied to the dissolution-physical development system. Thus, it can be seen that the diffusion-physical development system is a special area.

Also, in addition to the compounds used in the present invention, compounds, e.g., $CH_3CH_2CH_2NH_2$, $NH_2CH_2CH_2CH_2NH_2$, etc., as described in German Pat. O.L.S. No. 2,300,772 are known as sensitizing agents. However, these compounds possess difficulties in that they have a strong offensive odor specific to amines and in that they possess too strong a reducing power and increase the fog of the negative emulsion, resulting in a reduction in the density of the dye images. The compounds of the present invention having a hydroxy group in their molecule possess less odor, have a suitably low reducing power and exhibit a suitable silver halide dissolving ability and are, therefore, excellent as an additive to a processing solution in accordance with the dissolution-physical development system.

Since the compounds of the present invention having a hydroxy group in their molecule possess less odor and possess a suitably low reducing power, they do not have the defect that even an unexposed emulsion is indiscriminately developed and they possess a suitable silver halide dissolving ability. Thus, they are excellent as an additive to a processing solution in accordance with the dissolution-physical development system.

Several terms as used herein in the specification and description of the present invention are explained below.

As to "diffusibility," when a sufficient quantity of a substance, contained in each layer of the film unit or in the layer formed upon processing, to cause photographic effects diffuses into another layer, this substance is referred to as being diffusible, whereas a substance which diffuses only in an insufficient amount to substantially cause any photographic effects is referred to as being non-diffusible. Effective ingredients rendered non-diffusible through means such as association or polymerization are sometimes referred to as being diffusion-resistant or ballasted. These terms are used in the manner conventionally employed in the color photographic field. The degree or extent of diffusion is appropriately determined taking as a standard the conditions of the photographic layer into which the processing composition has permeated. More specifically, with respect to the film unit of the present invention, the extent of diffusion is appropriately determined based on the degree of diffusion in a hydrophilic colloid layer such as a gelatin layer containing an alkaline aqueous solution of a pH of about 10.

The terms "color sensitivity" and the "absorption of dyes" are employed in their conventional manner widely accepted in subtractive color reproduction photography.

The present invention can also be applied to a system which contains auxiliary color-correcting means in addition to the three main colors employed in subtractive color reproduction photography.

The coupler which is contained in a light-insensitive layer and which provides a diffusible dye is said to be colorless in such a sense and extent that the coupler possesses no absorption of light in the light-sensitive wavelength region of the unit containing the coupler which absorption greatly reduces the sensitivity of the light-sensitive emulsion and that the processed light-sensitive element does not possess an absorption which seriously deteriorates the property of the element as a negative original for color printing.

The image distribution-transmitting material used in the present invention plays, in each light-sensitive layer unit, a role of transmitting information controlling the image distribution. That is, the material migrates from a negative-imagewise developed light-sensitive emulsion layer to a light-insensitive layer associated therewith and functions to cause a reduction of silver with a reversal positive image distribution corresponding to the negative image in the light-sensitive emulsion layer.

The image distribution-forming material can be either (i) a development product produced with a negative image distribution simultaneously with the development of the light-sensitive emulsion layer or (ii) a substance which is initially incorporated uniformly in the light-sensitive emulsion layer and, upon development of the light-sensitive emulsion layer, is consumed with a negative distribution, leaving a positive distribution of the substance which is rendered diffusible with the processing composition. In the light-insensitive layer of each light-sensitive layer unit, a positive image-forming material is incorporated which causes silver reduction of a positive image by the action of the image distribution-transmitting material or which facilitates silver reduction.

As such image-reversing method utilizing the effects of the adjacent layer, a method of causing the development-controlling effects of the development product from the light-sensitive emulsion to act on the adjacent, substantially light-insensitive fogged emulsion layer and a method of dissolving non-developed silver halide emulsion grains in the light-sensitive emulsion layer with a complexing agent and transferring the dissolved silver to an adjacent layer containing physical development nuclei are particularly useful for the film unit of the present invention. Positive diffusion transfer dye images can be obtained by processing the light-insensitive layer provided adjacent the negative silver halide emulsion layer and containing a diffusible dye-releasing coupler and physical development nuclei, with a developer containing a solvent for silver halide. Suitable techniques for forming reversal dye images utilizing physical development which can be employed are those described in U.S. Pat. No. 3,227,550, etc.

The ballasted couplers which provide non-diffusible dyes are compounds which contain both a coupler nucleus residue capable of reacting with an oxidation product of an aromatic primary amino color developing agent to form a dye structure and a hydrophobic residue having 8 or more carbon atoms. The coupler nucleus residues can be those described in C.E.K. Mees and T. H. James, *The Theory of the Photographic Process*, 3rd Ed., pp. 383 ~ 394, Macmillan, (1966) and W. Pelz, *Farbkuppler*, pp. 111 ~ 175, Agfa Mitteilungen (Leverkusen) III, Springer, (1961), as well as a phenol residue, an aniline residue and an open-chain or cyclic active methylene group-containing residue. The hydrophobic residue functions to reduce the solubility of the coupler in an aqueous medium or reduce the diffusibility thereof in photographic layers by the action of increasing the cohesive force between the coupler molecules or between the coupler molecule and an oily substance to thereby increase intermolecular association, or the like. Useful hydrophobic residues are a straight or branched chain alkyl group such as an n-octyl group, a 2-ethylhexyl group, t-octyl group, an n-nonyl group, a triisopropyl group, a decyl group, an n-dodecyl group, a 1,1-dimethylhexadecyl group, a stearyl group, etc.; a cycloalkyl group such as 2,4-di-n-amylcyclohexyl group, etc.; an alkenyl grop such as an oleyl group, etc.; an aryl group such as a terphenyl group, etc.; a haloalkyl group such as an 8,9-dichloroheptadecyl group, a perfluorooctyl group, etc.; an alkoxyalkyl group or an alkylthioalkyl group such as a 3-n-dodecyloxypropyl group, a 2-n-dodecylthiopropyl group, etc.; an alkylaryl group such as a 4-t-amylphenyl group, a p-n-octylphenyl group, a 2,4-di-t-butylphenyl group, a 2,4-di-t-amylphenyl group, a 3-n-pentadecylphenyl group, etc.; an alkoxyaryl group such as a 3-n-hexyloxyphenyl group, a 3-n-dodecyloxyphenyl group, a 2-n-dodecyloxyphenyl group, etc.; and the like. These hydrophobic residues can be connected to the coupler nucleus residue either directly or through a divalent linking group such as an alkylene group, an arylene group, an oxyalkylene group (—O-alkylene-group) (e.g., an oxymethylene group, an α-oxyethylene group, an α-oxypropylene group, an ω-oxybutylene group, etc.), an amido group, a carbamyl group, a sulfonamido group, a sulfamyl group, an ureido group, an imido group (e.g.,

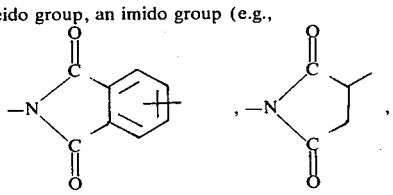

etc.), a carbonyl group, a carbonyloxy group, an oxycarbonyl group, a sulfonyl group, a sulfonyloxy group, an oxysulfonyl group, or the like. With coupler nuclei without water-solubilizing groups such as a sulfo group or a carboxy group, the hydrophobic group can be contained in the substituent positioned at the coupling site which is eliminated by the oxidation product of an aromatic primary amino color developing agent. The ballasted couplers used in the present invention can contain water-solubilizing groups such as a sulfo group, a carboxy group, a sulfonamido group, etc. In the so-called Fischer type couplers containing such water-solubilizing groups, the hydrophobic residues preferably contain about 12 to 32 carbon atoms, whereas in the so-called oleophilic protect-type couplers without such hydrophilic groups, the hydrophobic residues preferably contain about 8 to 32 carbon atoms.

Specific examples of the ballasting group comprising the hydrophobic group and the linkage group particularly suitable for the ballasted couplers are: a fatty acid amido group such as an n-lauroylamido group, a stearoylamido group, an oleoylamido group, etc.; a carbamyl group substituted with an alkyl or alkenyl group, such as an N-laurylcarbamyl group, an N-methyl-N-stearylcarbamyl group, an oleylcarbamyl group, etc.; substituted aliphatic amido groups as described in U.S. Pat. Nos. 3,337,344 and 3,418,129; an α-(2,4-di-t-amylphenoxy)acetamido group as described in U.S. Pat. No. 2,600,788; an α-(2,4-di-sec-amylphenoxy)acetamido group as described in British Patent 1,149,514; an α- or γ-(3-pentadecylphenoxy)-butyramido group as described in U.S. Pat. No. 2,908,573; aliphatic amido groups substituted with an alkylaryloxy group, such as an α-dimethyl-α-(3-pentadecylphenoxy)acetamido group; aliphatic amido groups substituted with a water-solubilizing group, such as a 1-octadecenyl-succinmonoamido group, an α-sulfostearoylamido group, etc.; alkoxy groups such as an octadecyloxy group, etc.; ester groups such as a cetyloxycarbonyl group as described in U.S. Pat. Nos. 3,409,439 and 3,551,155; sulfamyl groups such as an N,N-dioctylsulfamyl group, etc.; and the like.

As the nucleus of the coupler providing a yellow dye, an α-acylacetamido residue and, particularly preferably, an α-acylacetanilido residue are useful. These residues can be connected to the above-described ballasting groups containing the hydrophobic residue in the acylamido(anilino) group and the eliminatable residue at the coupling position. The above-described coupler nuclei can further be substituted with substituents such as a halogen atom, an alkyl group, an alkoxy group, an amyloxy group, a carbonyl group, a sulfo group, an alkoxycarbonyl group, a sulfamyl group, an acylamido group, a sulfonamido group, an amino group, a nitro group, a cyano group, etc.

The ballasted couplers which can be advantageously used in the present invention providing non-diffusible yellow dyes can be selected from conventionally known yellow couplers as described in Mees and James, supra, and Pelz, supra. α-Benzoylacetamide couplers containing a water-solubilizing group, as described in BIOS 1901, FIAT 943 and Japanese Patent Publication No. 6030/65; oleophilic α-benzoylacetamide couplers as described in U.S. Pat. Nos. 2,407,210; 2,875,057; 3,409,439; 3,551,155; 3,551,156; 3,649,276; 2,685,995; British Pat. No. 1,286,411; α-pivaloylacetamide couplers as described in U.S. Pat. No. 3,265,506; and the like are particularly useful for the practice of the present invention. Furthermore, one hydrogen atom located at the α-position of these α-acylacetamido groups can be substituted with a residue which can be eliminated as an anion, such as an arylthio group, a heterocyclic thio group, a halogen atom such as a fluorine atom as described in U.S. Pat. No. 3,277,155, a thiocyano group as described in U.S. Pat. No. 3,253,924, an acyloxy group as described in U.S. Pat. No. 3,447,928, an aryloxy group as described in U.S. Pat. No. 3,408,194, a sulfonyloxy group as described in U.S. Pat. No. 3,415,652, a diacylamino group as described in German Pat. OLS No. 2,213,461, etc.

Typical preferable yellow couplers include the following couplers.

Y-1. α-(4-Stearoylaminobenzoyl)aceto-3,5-dicarboxyanilide

Y-2. α-[4-(α-Octadecenylsuccinmonoamido)benzoyl]aceto-2-methoxy-5-carboxyanilide Y-3. α-(4-Octadecyloxybenzoyl)aceto-2-methoxy-5-sulfoanilide potassium salt Y-4. α{3-[α-(2,4-Di-t-amylphenoxy)butyramido]-benzoyl}aceto-2-methoxyanilide Y-5. α-(4-Methoxybenzoyl)aceto-2-chloro-5-[α-(2,4-di-t-amylphenoxy)butyramido]anilide Y-6. α-Benzoylaceto-2-chloro-5-dodecylarboxylanilide Y-7. α-(2-Methoxybenzoyl)aceto-2-chloro-5-tetradecyloxycarbonylanilide Y-8. α-(2-Methylbenzoyl)aceto-2-chloro-5-[N,N-bis(2-ethylhexyl)sulfamyl]anilide Y-9) α-(2-Methoxybenzoyl)-α-(5,5-dimethyl-3-hydantoinyl)aceto-2-chloro-5-[α-(2,4-di-t-amylphenoxy)butyramido]anilide Y-10. α-Pivaloyl-α-(4-carboxyphenoxy)aceto-2-chloro-5-[α-(3-pentadecylphenoxy)-butyramido]anilide As the nuclei for the couplers which can be used in the present invention providing magenta dyes, a 5-pyrazolone residue, a pyrazolobenzimidazole residue, an indazolone residue and a 1-H-pyrazolo[3,2]-s-triazole residue are useful. In particular, the 1-aryl-5pyrazolones are useful. In the present invention, 5-pyrazolone compounds having in the 1-position an unsubstituted phenyl group or a phenyl group substituted with a halogen atom, an alkyl group, an alkoxy group, an aryloxy group, an acylamino group, a sulfonamido group, a carbamyl group, a sulfamyl group, an alkoxycarbonyl group, a cyano group, a nitro group, a carboxy group, a sulfo group, etc., and the 5-pyrazolone compounds substituted in the 3-position with an alkyl group, an alkoxy group, an aryloxy group, an amino group (e.g., an anilino group, etc.), an acylamino group, a sulfonamido group, an ureido group, a carbamyl group, an alkoxycarbonyl group, etc., can be used with great advantage. Also, the corresponding acylated products of these 5-pyrazole compounds can be similarly used. The ballasting group containing a hydrophobic residue is advantageously contained in the substituent at the 1- or 3-position of the 5-pyrazolone compounds.

The ballasted couplers which can be advantageously used in the present invention providing non-diffusible magenta dyes can be selected from those known and descirbed in Mees and James, supra, and Pelz, supra, and in the literature. 1Phenyl-3-alkyl-5-pyrazolone couplers containing a water-solubilizing group, described in BIOS 1901, FIAT 943; 3-alkoxy-5-pyrazolone couplers as described in U.S. Pat. No. 2,439,098; 3-acylamino-5-pyrazolone couplers as described in U.S. Pat. Nos. 2,600,788; 3,062,653; etc.; 3-amino-5-pyrazolone couplers as described in British Pat. No. 956,261 and German Pat. OLS No. 2,015,867; 3-arylureido-5-pyrazolone couplers as described in U.S. Pat. No. 3,558,319; and the like are particularly useful for the practice of the present invention. Furthermore, one hydrogen atom of the active methylene group at the 4-position of the 5-pyrazolones can be substituted with a residue which can be eliminated with the oxidation product of the aromatic primary amino color developing agent, such as an arylazo group; a heterocyclic azo group; an arylthio group; a heterocyclic thio group; a thiocyano group as described in U.S. Pat. No. 3,253,924; an aryloxy group as described in U.S. Pat. No. 3,419,391; an acyloxy group as described in U.S. Pat. No. 3,311,476; a triazolyl group as described in U.S. Pat. No. 3,415,652; an alkoxycarbonyloxy group; an arylidene or alkylidene group as described in U.S. Pat. Nos. 2,706,683; 2,618,641; 3,468,666; and the like.

Typical preferable magenta-forming couplers include the following couplers.

M-1. 1-(3-Sulfo-4-phenoxyphenyl)-3-heptadecyl-5-pyrazolone potassium salt

M-2. 1-Phenyl-3-(α-octadecenylsuccinmonoamido)-5-pyrazolone

M-3. 1-Phenyl-3-{2-chloro-4-[β-n-(4-dodecyl-phenyl)acetylamino-β-carboxy-propylamino]anilino}-5-pyrazolone

M-4. 1-Phenyl-3-{3-[α-(2,4-di-sec-amylphenox-y)acetamido]benzoylamino}-5-pyrazolone

M-5. 1-(2,4,6-Trichlorophenyl)-3-{3-[α-(2,4-di-t-amylphenoxy)butyramido]benzoylamido}-5-pyrazolone M-6. 1-Phenyl-3-{3-[α-(3-pentadecylphenoxy)-butyramido]phenyl}-ureido-5-pyrazolone M-7. 1-(2,6-Dichloro-4-methoxyphenyl)-3-{3-[α-2,4-di-t-amylphenoxy)butyramido]phenylureido}-5-pyrazolone M-8. 1-(2,4,6-Trichlorophenyl)-3-(2-chloro-5-myristoylamidoanilino)-5-pyrazolone M-9. 1-Phenyl-3-(2-chloro-5-tetradecyloxycarbonylanilino)-5-pyrazolone M-10. 1-(2,4,6-Trichlorophenyl)-3-[3-{α-(2,4-di-t-amylphenoxy)acetamido}benzamido]-5-pyrazonyl(4)-benzylcarbonate M-11. 1-(2,4,6-Trichlorophenyl-3-(2,4-dichloroanilino)-4-(3-N-octadecylcarbamyl-phenylthio)-5-pyrazolone M-12. 1-(2,4,6-Trichlorophenyl)-3-[3-{α-(2,4-di-t-amylphenoxy)acetamido}benzamido]-4-(4-methoxyphenylazo)-5-pyrazolone As the nuclei for the couplers which can be used in the present invention providing cyan dyes, compounds having a phenolic hydroxy group, in particular, phenolic compounds and α-naphtholic compounds, are useful. Of these, phenol derivatives substituted with an acylamino group at the o- or m-position and α-naphthol derivatives substituted with a carbamyl group at the 2-position are particularly useful. The ballasting group containing a hydrophobic residue is usefully introduced into the coupler nucleus as the acylamino group or as the carbamyl group. In these couplers, the p-position to the hydroxy group is the reaction site with an oxidized aromatic primary amino color developing agent. This reaction site can be either unsubstituted or substituted with a residue which can be eliminated by the oxidized developing agent. Other nucleus positions can be substituted with a halogen atom, an alkyl group, an alkoxy group, an aryloxy group, an acylamino group, a sulfonamido group, a carbamyl group, a sulfamyl group, an alkoxycarbonyl group, a cyano group, a nitro group, a carboxy group, a sulfo group, a heterocyclic group (e.g., a 2-triazolyl group, a 2-imidazolyl group, etc.), and the like. The phenolic hydroxy group can be converted into an acylated form which can be hydrolyzed by an alkaline aqueous solution. The ballasted couplers which can be advantageously used in the present invention providing non-diffusible cyan dyes can be selected from those known and described in Mees and James, supra, and by Pelz, supra, or in other literature. 2-Naphthamide couplers having a sulfo group, as described in BIOS 1901, FIAT 943; acylaminophenol couplers as described in U.S. Pat. Nos. 2,367,531; 2,369,929; 2,423,730; diacylaminophenol couplers as described in U.S. Pat. Nos. 2,772,162; and 2,895,926; oil-soluble 2-naphthamide couplers as described in U.S. Pat. No. 2,474,293; N,N-di-substituted naphthamide couplers as described in U.S. Pat. No. 3,591,383; and the like are particularly useful. These phenol derivative can be substituted at the 4-position with a halogen atom such as a fluorine atom or a chlorine atom; an arylazo group; a heterocyclic azo group; an arylthio group; a heterocyclic thio group; an alkoxy group; an aryloxy group; a thiocyano group as described in U.S. Pat. No. 3,253,924; an imido group as described in U.S. Pat. No. 3,458,315; an aminomethyl group as described in U.S. Pat. No. 3,419,390, or the like.

Typical preferred cyan-forming couplers include the following couplers.

C-1. 1-Hydroxy-4-sulfo-N-octadecyl-2-naphthamide sodium salt

C-2. 1-Hydroxy-2′-(N-methyl-N-octadecylamino)-5′-sulfo-2-naphthanilide potassium salt C-3. 1-Hydroxy-N-[β-(α-sulfostearoylamido)ethyl]-2-naphthanilide sodium salt C-4. 1Hydroxy-N-[γ-(2,4-di-t-amylphenoxy)propyl]-2-naphthamide C-5. 1-Hydroxy-4-chloro-N-dodecyl-2-naphthamide C-6. 1-Hydroxy-2′-chloro-5′-{[β-(2,4-di-t-amylphenoxy)ethoxy]carbonyl}-2-naphthanilide C-7. 4,6-Dichloro-5-methyl-2-[α-(2,4-di-t-amylphenoxy)butyramido]phenol C-8. 2-Heptafluorobutyramido-5-[α-(2,4-di-t-amylphenoxy)caprolyamino]phenol C-9. 1-Hydroxy-4-(2-ethoxycarbonylphenylazo)-N-(2-ethylhexyl)-2-naphthamide The couplers which can be used in the present invention providing diffusible dyes are reactive, non-diffusible, substantially colorless compounds which are capable of coupling with an oxidized developing agent and which, as a result of the coupling reaction, eliminate and release a dye soluble and diffusible in the developing composition. Such couplers can be represented by the following general formula;

(Cp) — L — (Bl)

wherein Cp represents a coupling reactive structure moiety in which the coupling position is substituted with the (Bl)-L-residue and, when the coupler is used in combination with a developing agent without a water-solubilizing group such as a sulfo group or a carboxy group, the Cp residue contains a water-solubilizing group (e.g., a sulfo group, a carboxy group, a sulfonamido group, etc.) in at least one non-coupling position. As the coupling reactive structure moiety utilized as Cp, many functional groups which are known to undergo an oxidative coupling reaction with an aromatic primary amino color developing agent can be illustrated. Those described hereinbefore as the nuclei of the couplers providing non-diffusible dyes can similarly be used. Suitable examples include phenols, anilines, cyclic or open-chain active methylene compounds, and hydrazones. Specific examples of particularly useful reactive structure moieties include those derived from acylamino-substituted phenols, 1-hydroxy-2-naphthoic acid amides, N,N-dialkylanilines, 1-aryl-5-pyrazolones (the 3-position being substituted with an alkyl group, an aryl group, an alkoxy group, an aryloxy group, an amino group, an acylamino group, a ureido group or a sulfonamido group), pyrazolobenzimidazoles, pyrazolotriazoles, α-cyanoacetophenones and α-acylacetanilides.

The connecting or linkage group L whose bond to the coupler structure moiety is cleaved with an oxidized developing agent can be an azo group, an azoxy group, a mercuryl group (—HG—), an oxy group, a thio group, a dithio group, a triazolyl group, a diacylamino group, an acylsulfonamino group

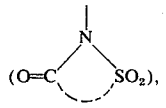

an acyloxy group, a sulfonyloxy group, and an alkylidene group. Of these, an oxy group, a thio group, a dithio group, a diacylamino group, an acyloxy group, etc., which are eliminated as an anion, are useful since a large amount of the diffusible dye is released. The coupling position of the coupling structure moiety of the phenol or naphthol is preferably substituted with a group connected through an oxy group, a thio group or a diacyloxy group. Also, the coupling position of a pyrazolone is preferably substituted with an azo group, a thio group, or an acyloxy group, and the coupling position of an acylacetanilide is preferably substituted with an oxy group, a thio group or a diacylamino group. The hydrophobic residues contained in the residues represented by Bl are essentially same as the above-described hydrophobic groups of the couplers providing non-diffusible dyes, and impart a cohesive force between the coupler molecules in an aqueous medium to render the molecules non-diffusible in a hydrophilic colloid constituting a light-sensitive material. As hydrophobic residues, a substituted or unsubstituted alkyl group, an alkenyl group, an aralkyl group and an alkylaryl group, having about 8 or more carbon atoms can be advantageously used. Specific examples include a lauryl group, a stearyl group, an oleyl group, a 3-n-pentadecylphenyl group, a 2,4-di-t-amylphenoxy group, and the like. These hydrophobic residues can be connected, directly or through a divalent bond such as an amido bond, a ureido bond, an ether bond, an ester bond or a sulfonamido bond, to residues such as an aryl group or a heterocyclic group to form Bl. The water-solubilizing group contained in the residue represented by Cp is an acidic group capable of being substantially dissociated in a processing composition or a precursor which provides such an acidic group upon hydrolysis. In particular, acidic groups having a pKa of not more than about 11 are useful. Examples of such groups are a sulfo group, a sulfuric ester group (—O—$SO_3H$), a carboxy group, a sulfonamido group, a diacylamino group, a cyanosulfonamino group, a phenolic hydroxy group, etc.

The diffusible dye-releasing couplers which can be used in the present invention undergo, upon reaction with an oxidized developing agent, cleavage of the L—Cp bond to provide a soluble dye, which is an oxidative coupling reaction product between Cp and the developing agent, and a non-diffusible, substantially colorless, eliminated product derived from Bl—L—. The resulting soluble dye diffuses into an image-receiving layer to form a dye image there.

Suitable diffusible dye-providing couplers which can be used in the present invention with advantage include the following couplers.

α-(4-Methoxybenzoyl)-α-(3-octadecylcarbamylphenylthio)-3,5-dicarboxyacetanilide α-Pivalyl-α-(3-octadecylcarbamylphenylthio)-4-sulfoacetanilide potassium salt 1-Phenyl-3-(3,5-dicarboxyanilino)-4-(3-octadecylcarbamylphenylthio)-5-pyrazolone 1-Phenyl-3-(3,5-disulfobenzoylamino)-5-(2-hydroxy-4-n-pentadecylphenylazo)-5-pyrazolone 1-[4-(3,5-Dicarboxybenzamido)phenyl]-3-ethoxy-4-(3-octadecylcarbamylthio)-5-pyrazolone 1-Hydroxy-4-(3-octadecylcarbamylphenylthio)-N-ethyl-3′,5′-dicarboxy-2-naphthanilide 1-Hydroxy-4-(n-octadecylsuccinimido)-N-ethyl-3′,-5′-carboxy-2-naphthanilide Other specific examples of the diffusible dye-releasing couplers and the synthesis thereof are described in British Pat. Nos. 840,731; 904,364; 1,085,631, U.S. Pat. Nos. 3,476,563; 3,644,498 and 3,419,391.

The aromatic primary amino developing agents which can be used in this invention advantageously include p-aminophenols, p-phenylenediamines and the derivatives thereof. In particular, 2-chloro-4-aminophenol, 2,6-dichloro-4-aminophenol, 4-amino-N,N-diethyl-3-methylaniline, N,N-diethyl-p-phenylenediamine, N-ethyl-β-methanesulfonamidoethyl-3-methyl-4-aminoaniline, 4-amino-N-ethyl-N-(δ-sulfobutyl)aniline, 4-amino-N-ethyl-N-(β-hydroxyethyl)aniline, 4-amino-3-methyl-N-ethyl-N-(βhydroxyethyl)aniline, 4-amino-N-ethyl-N-(βcarboxyethyl)aniline, 4-amino-N,N-bis(β-hydroxyethyl)-3-methyl-aniline, 3-acetamido-4-amino-N,N-(β-hydroxyethyl)aniline, 4-amino-N-ethyl-N-(β-hydroxyethyl)-3-methoxyaniline, and the salts of these anilines such as the hydrochloride, sulfate, oxalate, p-toluenesulfonate, etc. salt are useful. Furthermore, precursors of the developing agents such as the Schiff bases of these anilines and phthalimides are useful since they can be added to the light-sensitive element.

The ballasted couplers can be dispersed in a carrier, hydrophilic colloid, using various methods depending upon the type of the dye image-providing material. For example, couplers having a dissociative group such as a sulfo group or a carboxy group can be added to the hydrophilic colloid solution after being dissolved in water or in an alkaline aqueous solution. With couplers which are slightly soluble in an aqueous medium and readily soluble in an organic solvent, the couplers are first dissolved in an organic solvent, and then the resulting solution is added to a hydrophilic colloid solution, followed by stirring or the like to disperse the solution as fine particles. Suitable solvents are ethyl acetate, tetrahydrofuran, methyl ethyl ketone, cyclohexanone, β-butoxy-β-ethoxyethyl acetate, dimethylformamide, dimethylsulfoxide, 2-methoxyethanol, tri-n-butylphthalate, etc. Of these dispersion solvents, those solvents which possess a comparatively high vapor pressure can be evaporated upon drying of the photographic layers, or can be evaporated using the method described in U.S. Pat. Nos. 2,322,027 and 2,801,171 prior to coating. Of these dispersion solvents, those solvents which are readily soluble in water can be removed by washing with water according to the method described in U.S. Pat. Nos. 2,949,360 and 3,396,027.

In order to stabilize the dispersion of the coupler and accelerate the dye image-forming step, it is advantageous to incorporate, in the light-sensitive element, a solvent which is substantially insoluble in water and having a boiling point of not less than about 200°C at ordinary pressure, together with the coupler. Suitable high boiling solvents suitable for this purpose include fatty acid esters such as triglycerides of higher fatty acids and dioctyl adipate; phthalic esters such as di-n-butyl phthalate; phosphoric esters such as tri-o-cresyl phosphate and tri-n-hexyl phosphate; amides such as N,N-diethyllaurylamide; hydroxy compounds such as 2,4-di-n-amylphenol; and the like. Furthermore, in order to stabilize the dispersion of the coupler and to accelerate the step of dye image formation, it is advantageous to incorporate in the light-sensitive element a polymer having affinity for the solvent together with the coupler. Polymers having affinity for the solvent and being suitable for this purpose include shellac, phenol-formaldehyde condensates, poly-n-butyl acrylate, n-butyl acrylate-acrylic acid copolymers, n-butyl acrylate-styrene-methacrylamide copolymers, and the like. These polymers can be dispersed in an organic solution together with the coupler and then dispersed in a hydrophilic colloid, or can be added, as a hydrosol prepared by emulsion polymerization or the like, to a hydrophilic colloid dispersion of the coupler.

In general, the dispersion of the coupler can effectively be conducted under great shearing force. For example, a high speed rotary mixer, a colloid mill, a high pressure milk homogenizer, a high pressure homogenizer as described in British Pat. No. 1,304,264, an ultrasonic emulsifying apparatus, and the like are useful. The use of a surface active agent as an emulsfying aid markedly serves to disperse the dye image-providing material. Typical surface active agents useful for the dispersion of the dye image-providing material used in the present invention are sodium triisopropylnaphthalenesulfonate, sodium dinonylnaphthalenesulfonate, sodium p-dodecylbenzenesulfonate, sodium dioctyl sulfocussinate, sodium cetyl sulfate and the anionic surface active agents as described in Japanese Patent Publication No. 4293/64. The combined use of these anionic surface active agents and higher fatty acid esters of anhydrohexitol shows particularly good emulsifying ability as described in U.S. Pat. No. 3,676,141.

The silver halide emulsion which can be used in the present invention is a colloidal dispersion of silver chloride, silver bromide, silver chlorobromide, silver bromoiodide, silver chlorobromoiodide or a mixture thereof. The halide composition is selected depending upon the purpose of the end use of the light-sensitive material and the processing conditions. In particular, a silver bromoiodide emulsion or a silver chlorobromoiodide emulsion containing about 1 mol% to 10 mol% iodide, not more than about 30 mol% chloride and the balance bromide is desirable. Useful silver halide grains have a mean grain size of about 0.1 μ to about 2 μ. For some end-use purposes of the light-sensitive material, silver halides having a uniform grain size are preferred. The grains can be in a cubic form, an octahedral form or in a mixed crystal form. These silver halide emulsions can be prepared using known conventional processes as described in P. Galfkides, *Chimie Photographique*, 2nd Ed., Chapters 18 to 23, Paul Montel, Paris (1957). That is, a soluble silver salt such as silver nitrate and a water-soluble halide such as potassium bromide are reacted with each other in the presence of a solution of protective colloid such as gelatin and crystals are allowed to develop in the presence of excess silver halide or a solvent for silver halide such as ammonia. At this occasion, a single or double jet method or a pAg-controlled double jet method can be employed as the precipitating method. Removal of the soluble salts from the emulsion can be effected by washing and dialysis of the cool-set emulsion, by the combination of the addition of a sedimenting agent such as an anionic polymer having sulfone groups, sulfuric ester groups or carboxy groups or an anionic surface active agent and the adjustment of pH, or by the combination of the use of an acylated protein such as phthaloyl gelatin as a protective colloid and the adjustment of pH, to thereby cause sedimentation.

The silver halide emulsions used in the present invention are preferably subjected to chemical sensitization employing a heat-treatment using the natural sensitizers contained in gelatin, a sulfur sensitizer such as sodium thiosulfate or N,N,N'-trimethylthiourea, a gold sensitizer such as a thiocyanate complex salt or thiosulfate complex salt of monovalent gold, or a reducing sensitizer such as stannous chloride or hexamethylene tetraamine. Also, emulsions which tend to form latent images on the surface of the silver halide grains and emulsions which tend to form latent images inside the silver halide grains as described in U.S. Pat. Nos. 2,592,550; 3,206,313, etc., can be used in the present invention.

The silver halide emulsions which can be used in the present invention can be stabilized with additives such as 4-hydroxy-6-methyl-1,3,3a,7-tetraazaindene, 5-nitroimidazole, 1-phenyl-5-mercaptotetrazole, 8-chloromercuriquinoline, benzenesulfinic acid, pyrocatechin, etc. In addition, inorganic compounds such as cadmium salts, mercury salts, complex salts of platinum group metals such as the chloro complex salt of palladium, and the like are also useful for stabilizing the light-sensitive material of the present invention. Furthermore, the silver halide emulsions which can be used in the present invention can contain sensitizing compounds such as a polyethylene oxide compound.

The silver halide emulsions used in the present invention can possess, if desired, a color sensitivity expanded with optical sensitizing dyes. Useful optical sensitizing dyes are cyanines, merocyanines, holopolar, cyanines, styryls, hemicyanines, oxanols, hemioxanols, and the like. Specific examples of optical sensitizing agents are described in P. Glafkides, supra, Chapters 35 to 41, and F. M. Hamer, *The Cyanine Dyes and Related Compounds*, (Interscience). In particular, cyanines in which a nuclear nitrogen atom is substituted with an aliphatic group having a hydroxy group, a carboxy group or a sulfo group, e.g., those described in U.S. Pat. Nos. 2,503,776; 3,459,553 and 3,177,210, are especially useful for the practice of the present invention.

The processing composition permeable layers used in the present invention such as the silver halide emulsion layer, the dye image-providing material-containing layer and the auxiliary layers (e.g., a protective layer, an interlayer, etc.) contain a hydrophilic polymer as a binder. Suitable hydrophilic polymers are gelatin, casein, gelatin modified with an acylating agent or the like, vinyl polymer-grafted gelatin, proteins such as albumin, cellulose derivatives such as hydroxyethyl cellulose, methyl cellulose, carboxymethyl cellulose, etc., polyvinyl alcohol, a partially hydrolyzed product of polyvinyl acetate, polyvinyl pyrrolidone, high molecular weight non-electrolytes such as polyacrylamide, polyacrylic acid, a partially hydrolyzed product of polyacrylamide, anionic synthetic polymers such as vinyl methyl ether-maleic acid copolymers, N-vinylimidazole-acrylic acid-acrylamide copolymers, synthetic polymer amphoteric electrolytes such as polyacrylamide having been subjected to the Hofmann reaction. These hydrophilic polymers can be used alone or in combination. Furthermore, these hydrophilic polymer layers can contain a latex-like polymer dispersion or hydrophobic monomers such as an alkyl acrylate, an alkyl methacrylate, etc. These polymers, particularly polymers having functional groups such as an amino group, a hydroxy group or a carboxy group can be rendered insoluble with various cross-linking agents without loss of processing solution composition permeability. Particularly useful cross linking agents include aldehyde compounds such as formaldehyde, glyoxal, glutaraldehyde, mucochloric acid, acrolein oligomer, etc.; aziridine compounds such as triethylenephosphoramide as described in Japanese Patent Publication No. 8790/62; epoxy compounds such as 1,4-bis(2',3'-epoxypropoxy)diethyl ether as described in Japanese Patent Publication No. 7133/59; active halogen compounds such as 2-hydroxy-4,6-dichloro-s-triazine sodium salt as described in U.S. Pat. No. 3,325,287; active olefin compounds such as hexahydro-1,3,5-triacryl-s-triazine; methylol compounds such as N-polymethylolurea, hexamethylol melamine, etc,; high molecular weight compounds such as dialdehyde starch or 3-hydroxy-5-chloro-s-triazinyl gelatin as described in U.S. Pat. No. 3,362,827, etc. These hydrophilic polymers can contain a cross linking-accelerating agent such as a carbonate or resorcin as well as the cross linking agent.

The photographic layers used in the present invention can be coated using various coating methods such as a dip coating method, a roller coating method, an air knife coating method, a bead coating method as described in U.S. Pat. No. 2,681,294, a curtain coating method as described in U.S. Pat. Nos. 3,508,947 and 3,513,017. In particular, with light-sensitive elements of a multi-layered structure, it is convenient to coat a number of layers at the same time using a multi-slit hopper as described in U.S. Pat. Nos. 2,761,417; 2,761,418; 2,761,419 and 2,761,791.

In order to facilitate the coating of the photographic layers used in the present invention, the coating composition advantageously can contain a variety of surface active agents as coating aids. Useful coating aids include nonionic surface active agents such as saponin, p-nonylphenol-ethyleneoxide adducts, alkyl ethers of sucrose, glycerin monoalkyl ethers, etc., anionic surface active agents such as sodium dodecylsulfate, sodium p-dodecylbenzenesulfonate, sodium dioctylsulfosuccinate, etc.; and amphoteric surface active agents such as carboxymethyl-dimethyllauryl ammonium hydroxide inner salt, "Deriphat 151," trade name produced by General Mills, Inc., betaine compounds as described in U.S. Pat. No. 3,441,413, British Pat. No. 1,159,825 and Japanese Patent Publication No. 21985/71.

In order to facilitate the coating of the photographic layers used in the present invention, the coating composition can contain various thickening agents. For example, in addition to those which increase the viscosity of the coating composition due to their own viscosity such as high molecular weight polyacrylamide, anionic polymers such as cellulose sulfate, poly-p-sulfostyrene potassium salt and acrylic polymers as described in U.S. Pat. No. 3,655,407 which exhibit a thickening action due to mutual interaction with a binder polymer contained in the coating composition are similarly useful.

The processing composition which can be used in the present invention is a liquid composition containing the processing components necessary for the development of the silver halide emulsion and necessary for the formation of the diffusion transfer dye image. The main solvent therein is water and, in some cases, a hydrophilic solvent such as methanol or methyl Cellosolve is additionally present. The processing composition contains alkali in an amount sufficient to maintain the pH at a level necessary for causing development of the emulsion layer and neutralizing acids produced during the various steps of development and dye image formation. Typical alkalis are sodium hydroxide, potassium hydroxide, calcium hydroxide dispersion, tetramethylammonium hydroxide, sodium carbonate, trisodium phosphate, diethylamine, etc. The processing composition preferably possesses a pH of not less than about 12 at room temperature (about 20° ~ 30°C). More preferably, the processing composition contains a hydrophilic polymer such as a high molecular weight polyvinyl alcohol, hydroxyethyl cellulose, sodium carboxymethyl cellulose or the like. These polymers impart to the processing composition a viscosity of not less than about 1 poise, preferably about 1,000 poise, at room temperature, which not only facilitates the uniform spreading of the composition upon processing but also the formation of an immovable film, upon concentration of the processing solution due to migration of the aqueous solvnet into the light-sensitive element and the image-receiving element in the course of the processing, thus serving to unify the film unit after processing. In addition, this polymer film can serve, after the substantial completion of the formation of the diffusion transfer dye image, to control further migration of coloring ingredients into the image-receiving layer, thereby preventing the image from being changed.

In some cases, the processing composition advantageously contains a light absorbent such as carbon black and a desensitizer as described in U.S. Pat. No. 3,579,333 so as to prevent the silver halide emulsion from being fogged by ambient light during processing. Furthermore, the processing composition advantageously contains additives such as a developer (e.g., a primary amino color developing agent, etc.), an antioxidizing agent (e.g., a sulfite, ascorbic acid, etc.), an antifogging agent (e.g., a halogen compound, 5-nitrobenzimidazole, etc.), and the like.

Suitable examples of silver halide solvents contained in the processing composition include alkali metal thiosulfates such as sodium thiosulfate and potassium thiosulfate, ammonium thiosulfate and alkyl ($CH_3$ or $C_2H_5$) bissulfonylmethane, etc. Alkali metal thiocyanates such as sodium and potassium thiocyanates, ammonium thiocyanate and uracil can be used in combination with the above compounds. A suitable amount is about 4 g/l to 9 g/l in the processing composition.

The processing composition used in the present invention is advantageously retained in a rupturable container. Such a container is advantageously produced by folding a sheet of a liquid- and air-impervious substance and sealing each edge to form a cavity in which the processing composition is retained, and the container is advantageously formed so that, when the film unit passes through pressure-applying members, the container is ruptured at a given portion due to the inner hydraulic pressure generated within the processing composition to thereby release the contents. Suitable advantageous materials for forming the container are a polyethylene terephthalate/polyvinyl alcohol/polyethylene laminate, a lead foil/vinyl chloride-vinyl acetate copolymer laminate or the like. This container is desirably fixedly positioned and extends transverse a leading (i.e., in the direction of travel of the film unit with respect to the pressure applying members) edge of the film unit whereby to effect a substantially unidirectional discharge of the contents of the container on the surface of the light-sensitive element. Preferred examples of such containers are described in U.S. Pat. Nos. 2,543,181; 2,643,886; 2,653,732; 2,723,051; 3,056,491; 3,056,492; 3,152,515 and 3,173,580. These containers are advantageous for the practice of the present invention.

The image-receiving element used in the invention fixes the dye image-forming materials such as the diffusible dyes, etc., which are released with an imagewise distribution from dye image-providing materials associated with the silver halide emulsion. Where dye developers having a hydroquinonyl group or anionic substances such as color dyes having an acidic water-solubilizing group are used as the dye image-forming material, the image-receiving element preferably contains a basic polymer or a basic surface active agent. As the basic polymer, those polymers which contain tertiary or quaternary nitrogen atoms are excellent. More specifically illustrative examples are poly-4-vinylpyridine, a polymer of the aminoguanidine derivative of vinyl methyl ketone as described in U.S. Pat. No. 2,882,156, poly-4-vinyl-N-benzyl-pyridinium p-toluenesulfonate, poly-3-vinyl-4-methyl-N-n-butylpyridinium bromide, styrene/N-(3-maleimidopropyl)-N,N-dimethyl-N-4-phenylbenzyl-ammonium chloride copolymer as described in British Pat. No. 1,261,925, poly[N-(2-methacryloylethyl)-N,N-dimethyl-N-benzylammonium chloride], etc. As the basic surface active agent, those surface active agents which contain an onium residue such as an ammonium, sulfonium or phosphonium residue and contain a hydrophobic residue such as a long-chain alkyl group are excellent. More specifically, suitable examples are N-laurylpyridinium bromide, cetyltrimethylammonium bromide, methyl-tri-n-laurylammonium p-toluenesulfonate, methyl-ethyl-cetylsulfonium iodide, benzyltriphenylphosphonium chloride, etc. In addition to these basic compounds, multi-valent metals such as thorium, aluminum, zirconium, etc., also exert a fixing action on the anionic dye image-forming materials. These substances advantageously form films together with polymers such as gelatin (in particular acid-processed gelatin), polyvinyl alcohol, polyacrylamide, polyvinyl methyl ether, hydroxyethyl cellulose, N-methoxymethylpolyhexylmethyleneadipamide, polyvinylpyrrolidone, etc.

Where the dye image-forming material is one component for forming a dye such as a diffusible coupler, the image-receiving layer contains other coupling components capable of reacting with this component to form a dye, such as a p-phenylenediamine derivative and an oxidizing agent, or a diazonium compound. This type of image-receiving element which can be used is described in U.S. Pat. Nos. 2,647,049; 2,661,293; 2,698,244; 2,698,798; 2,802,735; 3,676,124, British Pat. Nos. 1,158,440; 1,157,507, etc.

The film unit of the present invention can contain a developing agent scavenger which reacts with excess developing agent remaining after the processing to form a colorless product which is difficult to oxidize. In particular, a film unit which contains the above-described scavenger in the acidic substance-containing neutralizing layer, in the timing layer or in the image-receiving layer of the film unit provides distinct images with less stain. Film units which contain an aromatic primary amino developing agent, which tends to cause stain, advantageously contain as the scavenger a compound having a functional group capable of condensing with amines, such as an isocyanate, an aldehyde precursor and a vinylsulfonyl compound as described in German Pat. OLS Nos. 2,201,392; 2,225,480 and 2,225,497.

The diffusion transfer photographic film unit used in the present invention preferably possesses the function of neutralizing the alkali brought thereinto from a processing composition. The processing composition contains alkali so as to provide a pH of higher than about 10, preferably higher than 11, which is sufficiently high to accelerate the image-forming steps comprising the development of the silver halide emulsion, the formation of the diffusible dye image-forming material and the diffusion transfer. After the substantial completion of the formation of the diffusion transferred images, the pH in the film unit is reduced to around neutrality, i.e., less than about 9, preferably less than 8, whereby further image-formation is actually discontinued to prevent the image tone from being changed with the lapse of time and to control discoloration and fading of the images and stain of white background due to high alkalinity. For this purpose, the film unit advantageously contains a neutralizing layer containing an acidic substance in a sufficient quantity to neutralize the alkali contained in the processing composition to the above-described pH, that is, in an area concentration equivalent to or greater than the amount of alkali contained in the spread processing composition. Preferred acidic substances are those which contain an acidic group having a pKa of less than about 9, particularly a carboxy group or a sulfonic acid group, or which contain a precursor group capable of providing such an acidic group upon hydrolysis. More preferred examples are higher fatty acids such as oleic acid as described in U.S. Pat. No. 2,983,606, polymers of acrylic acid, methacrylic acid or maleic acid, the partially esterified polymers thereof, or acid anhydrides. Specific examples of high molecular weight acidic substances are copolymers of a vinyl monomer (e.g., ethylene, vinyl acetate, vinyl methyl ether, etc.) and maleic anhydride, and the n-butyl half ester thereof; copolymers of butyl acrylate and acrylic acid; cellulose acetate, hydrogen phthalate; and the like. In addition to these acidic substances, the neutralizing layer can contain polymers such as cellulose nitrate and polyvinyl acetate, and a plasticizer as described in U.S. Pat. No. 3,557,237. Furthermore, the neutralizing layer can be hardened through cross linking with a multifunctional aziridine compound, an epoxy compound, etc. The neutralizing layer can be positioned in either the image-receiving element and/or the light-sensitive element. In particular, the neutralizing layer is advantageously positioned between the support of the image-receiving element and the image-receiving layer. As is described in German Pat. OLS No. 2,038,254, the acidic substances can be microencapsulated for incorporation in the film unit.

The neutralizing layer or the acidic substance-containing layer used in the present invention is desirably separated from the spread processing composition layer by a neutralization rate-controlling layer or timing layer. This timing layer functions to prevent a disadvantageous reduction in the transfer image density due to a too fast reduction in pH before the necessary development of the silver halide emulsion layer and the formation of the diffusion transfer image are completed. That is, this layer functions to delay the reduction in the pH until the necessary development and transfer are completed. In a preferred embodiment of the present invention, the image-receiving element possesses a multi-layered structure comprising a support—a neutralizing layer—a timing layer— a mordant layer (image-receiving layer) in this sequence. The timing layer comprises mainly polymers such as gelatin, polyvinyl alcohol, polyvinyl propyl ether, polyacrylamide, hydroxypropylmethyl cellulose, isopropyl cellulose, copolymer of polyvinyl alcohol and polyvinyl butyral, partially hydrolyzed polyvinyl acetate, copolymers of $\beta$-hydroxyethyl methacrylate and ethyl acrylate, and the like. These polymers are usefully hardened through cross linking with an aldehyde compound such as formaldehyde, or an N-methylol compound. The timing layer preferably has a thickness of about 2 $\mu$ to 20 $\mu$.

In a preferred multi-layered structure for the film unit of the present invention, a blue-sensitive silver halide emulsion, a green-sensitive silver haldie emulsion and a red-sensitive silver halide emulsion are positioned in sequence from the side to be exposed. In particular, in the case of high speed emulsions containing silver iodide, a yellow filter can be positioned between the blue-sensitive silver halide emulsion and the green-sensitive silver halide emulsion. This yellow filter layer contains a yellow colloidal silver dispersion, an oil-soluble yellow dye dispersion, an acidic dye mordanted with a basic polymer, or a basic dye mordanted with an acidic polymer. The emulsion layers are advantageously separated from each other by interlayers. The interlayers prevent disadvantageous mutual interactions from occurring between the emulsion layer units having different color sensitivities. The interlayer is formed by a porous polymer containing fine pores and comprises a latex of a hydrophilic polymer and hydrophobic polymer, as described in U.S. Pat. No. 3,625,685 or a polymer whose hydrophilicity is gradually increased by the processing composition, such as calcium alginate, as described in U.S. Pat. No. 3,384,483, as well as a hydrophilic polymer such as gelatin, polyacrylamide, a partially hydrolyzed product of polyvinyl acetate, etc. The interlayer is effective for a reducing agent such as a ballasted hydroquinone derivative and a ballasted coupler capable of being fixed by the reaction with the oxidation product, to prevent the oxidation product of a developing agent from exchanging between emulsion units. Furthermore, in order to attain good color reproduction, in a system wherein image reversion is effected by dissolution-physical development, it is effective to further incorporate in the interlayer physical development nuclei such as colloidal metallic silver in the interlayer.

The support which can be used in the present invention is a substantially planar substance which does not undergo any serious dimensional change due to the processing composition used during processing. For some purposes, rigid supports such as a glass plate can be used. However, in general, flexible supports are useful. Suitable flexible supports which can be advantageously used are those generally used for photographic light-sensitive materials, such as a cellulose nitrate film, a cellulose acetate film, a polyvinyl acetal film, a polystyrene film, a polyethylene terephthalate film, a polycarbonate film, etc. Supports having dimensional stability and oxygen impervious properties such as a laminate in which a polyvinyl alcohol layer is sandwiched between polyethylene terephthalate layers or between cellulose acetate layers is particularly desirable since the laminate serves to provide a stable dye image and is stained to a lesser extent. In order to facilitate evaporation of moisture contained in the spread processing composition through the support after the processing, it is advantageous to use an aqueous vapor permeable support such as is described in U.S. Pat. No. 3,573,044. In order to prevent incident light leakage through the edge of the transparent support to the silver halide emulsion layer during the processing of the film unit in a bright place, the transparent support is desirably colored to such extent that transmission of light in a planar direction to the support can be prevented without inhibiting imagewise exposure and observation therethrough. If desired, the support can contain a plasticizing agent such as a phosphoric ester, a phthalic ester, etc., an ultraviolet light-absorbing agent such as 2-(2-hydroxy-4-t-butylphenyl)-benzotriazole, etc., an antioxidant such as a hindered phenol, etc. In order to maintain the adhesion between the support and the hydrophilic polymer-containing layer, it is advantageous to provide a subbing layer or to subject the surface of the support to a preliminary treatment such as corona discharge, irradiation with ultraviolet light or a flame treatment. The support usually has a thickness of about 20 to 300 $\mu$.

In the film unit of the present invention, a light-reflective substance is positioned between the image-receiving layer and the light-sensitive unit surface by the time of completion of the processing at the latest in order to form a white background of the dye image formed in the image-receiving layer. Suitable light-reflecting substances are titanium dioxide, barium sulfate, zinc oxide, alumina, barium stearate, calcium carbonate, silicon dioxide, zirconium oxide, kaolin, magnesium oxide, etc. These substances can be used alone or in combination. Such light-reflecting substance can be either initially formed or, as is described in U.S. Pat. Nos. 3,647,434 and 3,647,436, formed in a given position from a precursor distributed in a film unit. The light-reflecting substance can be incorporated in the layer which contains as a binder a hydrophilic polymer such as polyvinyl alcohol, gelatin, hydroxypropyl cellulose, polyvinyl pyrrolidone, etc. Furthermore, the light-reflecting substance can be compounded in the processing composition so that, upon spreading of the processing composition, the substance is fixed in a dispersed state in a layer of a film-forming polymer such as hydroxyethyl cellulose or carboxymethyl cellulose formed upon spreading the processing composition. The combined use of a light-reflecting substance and a fluorescent brightening agent such as a stilbene, a coumarin, triazine, an oxazole, etc., provides a beautiful white background. In order to protect the silver halide emulsion layer from ambient light during processing, it is advantageous to incorporate, as is described in U.S. Pat. Nos. 3,647,437 and 3,702,245, a dye which is colored at a pH higher than the pKa of the dye and which becomes colorless at a pH less than the pKa. The light-reflecting substance-containing layer advantageously has a light-reflecting substance/binder polymer composition ratio (by weight) of about 0.5 to about 100, and has a dry thickness of about 5 $\mu$ to 50 $\mu$. Also, the light-reflecting substance-containing layer possesses a reflectivity of not less than about 50%, preferably not less than 70%.

The film unit of the present invention has a rupturable container retaining the processing composition. When pressed by pressure-applying members, this container is ruptured due to the internal pressure to release the processing composition in a predetermined manner. A variety of pressure-applying members can be used. In particular, a pressure-applying member which comprises at least one pair of members juxtaposed with a certain gap or clearance is suited for the processing of the film unit of the present invention. A pair of members are fixedly positioned with a certain clearance or oppose one another through a spring or a like elastic body. The members can be rod-shaped, freely rotary rollers or motor-driven rollers. When a film unit is passed between a pair of juxtaposed pressure-applying members, the container is ruptured and the processing composition is released and spread between the two elements as a layer form. As the juxtaposed pressure-applying members, those described in U.S. Pat. Nos. 3,647,441 and 3,652,281 can be advantageously used.

In the film unit of the present invention, development processing is continued outside a camera, e.g., in a bright place. The silver halide emulsion layers are protected from ambient light until the development and the transfer of dye images are substantially completed. For this purpose, it is advantageous to provide a light-intercepting layer containing a light absorbent on the silver halide emulsion side. This light-intercepting layer is constituted so as to be processing composition permeable (hydrophilic) or processing composition impermeable (dimensionally stable), depending upon the position of the layer. The processing composition-permeable light-intercepting layer is a water permeable polymer layer of gelatin, polyvinyl alcohol, polyacrylamide, polyhydroxyethyl cellulose, carboxymethyl cellulose sodium salt, methyl cellulose, etc., containing a light-intercepting substance. This layer can be either coated in advance as a pre-formed layer or can be spread upon processing as a processing composition layer. On the other hand, the light-intercepting layer with dimensional stability is a polymer layer containing a light absorbent, as is described in Japanese Patent Publication No. 24547/68 and U.S. Pat. No. 3,607,818. This is contained in a film unit as a support or a light-intercepting element. Also, this dimensionally stable light-intercepting layer can be prepared from a foil or a metal such as aluminum, tin, etc., a laminate film of a metal foil and a polymer or a polyethylene terephthalate film having vacuum deposited thereon aluminum and a laminate film. It is preferred, from the standpoint of increased light-intercepting property and of beautiful appearance, to cover the light-intercepting layer with a light-reflecting substance such as titanium dioxide. Various light absorbents can be used in the light-intercepting layer. In particular, carbon powder such as carbon black, colloidal silver, organic pigments such as azo lake or copper phthalocyanine, water-insoluble azo dyes, an anthraquinone dye dispersion, polymers having been reacted with a reactive dye and micelle-forming hydrophilic dyes are useful. In many cases, it is necessary for the light-intercepting layer to possess an absorbance (to diffused light) of not less than about 3, preferably not less than 5 over the entire wavelength region of from about 350 m$\mu$ to 650 m$\mu$, preferably, from about 300 m$\mu$ to 750 m$\mu$, although this depends upon the purpose of use of the film unit. The dimensionally stable light-intercepting layer can advantageously be used as an adhesive tape in order to cover the edges of the transparent support thereby preventing light leakage through the edges of the film unit to the silver halide emulsion layers.

Accompanying FIG. 1 illustrates a cross sectional view of specific examples of the light-sensitive element, the image-receiving element and the processing composition container. The accompanying figure is drawn to clearly show the disposition of each constituent. Dimensions are not proportional and, in some cases, are greatly exaggerated. Light-sensitive element 1 contains light-sensitive member 61 which comprises transparent support 51 having provided on the one side of transparent support 51, in sequence, diffusible yellow dye-releasing light-insensitive layer 52, blue-sensitive silver halide emulsion layer 53 providing a non-diffusible yellow dye image, yellow filter layer 54, diffusible magenta dye-releasing light-insensitive layer 55, green-sensitive silver halide emulsion layer 56 providing a non-diffusible magenta dye image, interlayer 57, diffusible cyan dye-releasing light-insensitive layer 58 and red-sensitive silver halide emulsion layer 59 providing a non-diffusible cyan dye image. Light-intercepting layer 60 containing a light absorbent is coated thereon and backing layer 50 is coated on the opposite side of the support. Image-receiving element 2 contains image-receiving member 74 which comprises transparent support 70 having provided thereon, in sequence, neutralizing layer 71 containing an acidic substance, timing layer 72 and image-receiving layer 73. Processing solution container 4 is a pod prepared from, e.g., a laminate film of lead foil 92 and alkali-resistant polymer layer 91, and retains processing solution 93. Upon application of pressure to the processing solution container, the container is ruptured due to the inner pressure of the processing composition to release the contents.

FIG. 2 shows one embodiment of the film unit of the present invention. FIG. 2*a* shows the appearance of the light-sensitive side, and FIG. 2*b* the appearance of the transferred image side. In FIG. 2, numeral 1 designates a light-sensitive element, 2 an image-receiving element, 3 a light-intercepting element, 4 a processing composition container, 8 a white bordering sheet of the transferred image, and 9 a coating layer for covering the edges to intercept light.

In the film unit shown in FIG. 3, light-sensitive element 1 is supported in a camera by pressure plate 100 and is connected to leader paper 5 at the leading edge in the direction of travel. Image-receiving element 2 and light-intercepting element 3 are connected, respectively, to leader paper 6 and 7 each at the leading edge. These leader papers 5, 6 and 7 are connected to each other. The three elements are disposed so that they can be superposed one over the other with all edges meeting, by drawing the tip of leader paper 5. Processing solution container 4 is disposed on a leader paper so that the contents can be released between the light-sensitive element and the image-receiving element. In the state wherein the three elements are in an intimately superposed relationship, the silver halide emulsion layer of the light-sensitive element is protected from ambient light by both light-intercepting layer 60 and light-intercepting element 3. FIG. 4 shows a cross sectional view of the film unit illustrated in FIG 3. FIG. 4 shows that the light-sensitive element is disposed so as to be superposed with both backing layer 50 and transparent support 51 directed outside and both light-sensitive member 61 and light-intercepting layer 60 inside, and that the image-receiving element is disposed so as to be superposed with transparent support 70 directed outside and image-receiving member 74 inside. FIG. 4 also shows that the light-intercepting element is disposed so as to be superposed so that it can cover the backing layer and the transparent support of the light-sensitive element. FIG. 4 further shows that the processing composition container is disposed so that the contents can be positioned between leader paper 5 associated with the light-sensitive element and leader paper 6 associated with the image-receiving element.

The present invention will now be illustrated in greater detail by reference to the following non-limiting examples of preferred embodiments of the present invention. Unless otherwise indicated, all parts, percents, ratios and the like are by weight.

EXAMPLE 1

On one surface of a laminate film comprising a 25 $\mu$-thick polyvinyl alcohol film having coated on both sides thereof 38 $\mu$-thick triacetylcellulose films were coated, in sequence, the following layers to prepare a light-sensitive element.

1. A diffusible yellow dye-providing layer containing $1.6 \times 10^{-5}$ mol/100 cm$^2$ of diffusible yellow dye-providing coupler, $\alpha$-pivaloyl-$\alpha$-(3-octadecylcarbamylphenoxy)-3,5-dicarboxyacetanilide, 1 mg/100 cm$^2$ of t-octyhydroquinone, 12 mg/100 cm$^2$ of N,N-diethyllauramide, 0.1 mg/100 cm$^2$ of Carey-Lea type gold colloid and 16 mg/100 cm$^2$ of gelatin, the gold colloid being prepared by reducing chloroauric acid with sodium borohydride in the presence of gelatin and appearing pink.

2. An interlayer containing 5 mg/100 cm$^2$ of 2,5-di-t-octylhydroquinone and 13 mg/100 cm$^2$ of gelatin.

3. A blue-sensitive emulsion layer containing $2.4 \times 10^{-5}$ mol/100 cm$^2$ of yellow-forming coupler, $\alpha$-(2-methylbenzoyl)-2-chloro-5-n-dodecyloxycarbonylacetanilide, 4 mg/100 cm$^2$ of di-n-butyl phthalate, 18 mg/100 cm$^2$ of gelatin, and blue-sensitive negative type silver bromoiodide emulsion grains (iodide content: 3.0 mol%; mean grain size: 0.9 $\mu$) at a coverage of $14.6 \times 10^{-5}$ mol silver/100 cm$^2$.

4. An interlayer containing 5 mg/100 cm$^2$ of 2,5-di-t-octylhydroquinone and 13 mg/100 cm$^2$ of gelatin.

5. A second diffusible yellow dye-providing layer containing $0.8 \times 10^{-5}$ mol/100 cm$^2$ of diffusible yellow-providing coupler, $\alpha$-pivaloyl-$\alpha$-(3-octadecylcarbamylphenoxy)-3,5-dicarboxyactetanilide, 0.6 mg/100 cm$^2$ of t-octylhydroquinone, 6 mg/100 cm$^2$ of N,N-diethyllauramide, 0.05 mg/100 cm$^2$ of Carey-Lea type silver colloid and 8 mg/100 cm$^2$ of gelatin, the silver colloid being prepared by reducing silver nitrate with sodium borohydride in the presence of gelatin and appearing yellow.

6. An interlayer containing 7.0 mg/100 cm$^2$ of Carey-Lea type silver colloid, 5 mg/100 cm$^2$ of 2,5-di-t-octylhydroquinone and 13 mg/100 cm$^2$ of gelatin.

7. A diffusible magenta dye-providing layer containing $1.0 \times 10^{-5}$ mol/100 cm$^2$ of diffusible magenta dye-providing coupler, 1-phenyl-3-[2-chloro-5-($\gamma$-sulfobutyramido)anilino]-4-(3-N-methyl-N-octadecylcarbamylphenylthio)-5-pyrazolone, 1 mg/100 cm$^2$ of t-octylhydroquinone, 7 mg/100 cm$^2$ of N,N-diethyllauramide, 0.1 mg/100 cm$^2$ of Carey-Lea type silver colloid and 13 mg/100 cm$^2$ of gelatin.

8. An interlayer containing 5 mg/100 cm² of 2,5-di-t-octylhydroquinone and 13 mg/100 cm² of gelatin.

9. A green-sensitive emulsion layer containing 1.6 × $10^{-5}$ mol/100 cm² of magenta-forming coupler, 1-(2,6-dichloro-4-methoxy)-3-{3-[α-(2,4-di-t-amylphenoxy)-butyramido]phenyl ureido-5-pyrazolone, 65 mg/100 cm² of tri-o-cresyl phosphate, 16 mg/100 cm² of gelatin and silver bromoiodide emulsion grains (iodide content: 2.0 mol%; mean grain size: 0.7 μ) sensitized with the following sensitizing agents at a coverage of 9.3 × $10^{-5}$ mol silver/100 cm².

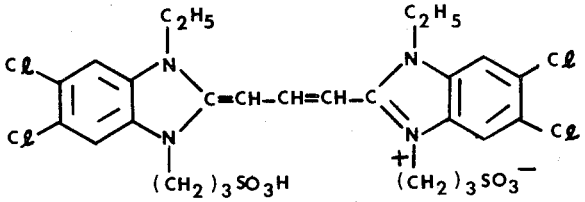

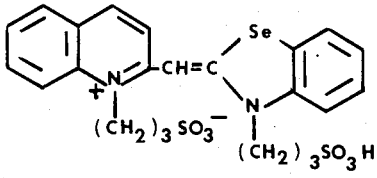

10. An interlayer containing 5 mg/100 cm² of 2,5-di-t-octylhydroquinone and 13 mg/100 cm² of gelatin.

11. A diffusible magenta dye-providing layer containing 0.6 × $10^{-5}$ mol/100 cm² of diffusible magenta dye-providing coupler, 1-phenyl-3-[2-chloro-5(γ-sulfobutyramido)anilino]-4-(3-N-methyl-N-octadecylcarbamylphenylthio)-5-pyrazolone, 0.6 mg/100 cm² of t-octylhydroquinone, 4 mg/100 cm² of N,N-diethyllauramide, 0.06 mg/100 cm² of Carey-Lea type silver colloid 7 mg/100 cm² of gelatin.

12. An interlayer containing 4.0 mg/100 cm² of Carey-Lea type silver colloid, 5 mg/100 cm² of 2,5-di-t-octylhydroquinone and 13 mg/100 cm² of gelatin.

13. A diffusible magenta dye-providing layer containing 1.2 × $10^{-5}$ mol/100 cm² of diffusible cyan dye-providing coupler, 1-hydroxy-4-(3-N-methyl-N-octylcarbamylphenylthio-N-ethyl-2′-methoxy-5′-(γ-sulfobutyramido)-2-naphthanilide, 0.8 mg/100 cm² of n-pentadecylhydroquinone, 8 mg/100 cm² of N,N-diethyllauramide, 0.1 mg/100 cm² of Carey-Lea type silver colloid and 16 mg/100 cm² of gelatin.

14. An interlayer containing 5 mg/100 cm² of 2,5-di-t-octylhydroquinone and 15 mg/100 cm² of gelatin.

15. A red-sensitive emulsion layer containing 1.8 × $10^{-5}$ mol/100 cm² of cyan-forming coupler, 1-hydroxy-N-[γ-(2,4-di-t-amylphenoxy)-propyl]-2-naphthamide, 4 mg/100 cm² of di-n-butyl phthalate, 14 mg/100 cm² of gelatin and silver bromoiodide emulsion grains (iodide content: 2.0 mol%; mean grain size: 0.7 μ) sensitized with the following sensitizers at a coverage of 10.8 × $10^{-5}$ mol silver/100 cm².

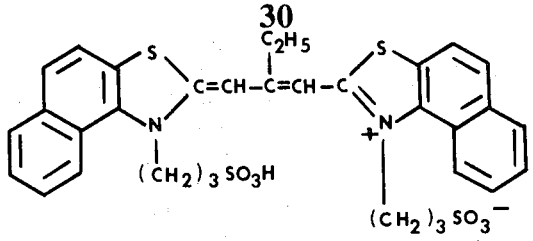

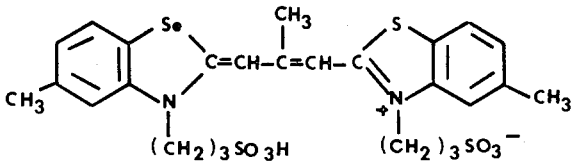

16. An interlayer containing 5 mg/100 cm² of 2,5-di-t-octylhydroquinone and 15 mg/100 cm² of gelatin.

17. A diffusible magenta dye-providing layer containing 0.6 × $10^{-5}$ mol/100 cm² of diffusible cyan dye-providing coupler, 1hydroxy-4-(3N-methyl-N-octyldecylcarbamylphenylthio)-N-ethyl-2′-methoxy-5′-(γ-sulfobutyramido)-2-napthanilide, 0.4 mg/100 cm² of n-pentadecylhydroquinone, 4 mg/100 cm² of N,N-diethyllauramide, 0.05 mg/100 cm² of Carey-Lea type silver colloid and 8 mg/100 cm² of gelatin.

The above-described layers (1) through (17) were hardened by incorporating 8% by weight, based on the gelatin, of 4-chloro-6-hydroxy-s-triazinyl-(2)-gelatin, prepared according to the description in Example 1 of U.S. Pat. No. 3,362,827.

On the resulting composite were further coated hardener-free layers described below.

18. A gelatin layer at a coverage of 7 mg/100 cm².

19. A mixture comprising 50 g of carbon black (furnace type), 2.5 g of α-(4-octadecyloxybenzoyl)-2-methoxy-5-sulfoacetanilide potassium salt, 0.5 g of sodium hydroxide and 150 ml of water was kneaded using a colloid mill to prepare a paste. To this was added 500 g of a 10% aqueous solution of gelatin and, under stirring, a 5% citric acid solution was added thereto to adjust the pH to 5.5. Then, the resulting mixture was coated in a dry thickness of 4.5 μ to complete a light-sensitive element.

Separately, on one surface of a transparent support of a laminate film comprising a 25 μ-thick polyvinyl alcohol film having coated on both sides 25 μ-thick polyethylene terephthalate films were coated, in sequence, the following layers to prepare an image-receiving element.

1. A neutralizing transparent layer containing 300 mg/100 cm² of the half ester prepared by treating vinyl methyl ether-maleic anhydride copolymer with n-butyl alcohol, 60 mg/100 cm² of 1,4-bis(2′,3′-epoxy)butane and 21 mg/100 cm² of hexahydro-1,3,5-triacryl-s-triazine.

2. A timing layer comprising 45 mg/100 cm² of n-butyl acrylate-β-hydroxyethyl methacrylate copolymer (monomer molar ratio: about 1.1).

3. An image-receiving layer containing 18 mg/100 cm² of cetyl-tri-n-butylammonium chloride, 40 mg/100 cm² of gelatin and 2 mg/100 cm² of tetramethylol urea.

4. The resulting surface was processed with a 1% acetone solution of polyethyleneglycol(1000)monocetyl ether to form a coating film of a thickness of about 0.5 μ.

Then, processing solutions having the following formulations containing as a development accelerator each of the following compounds were prepared. A rupturable container capable of retaining 1 ml of each processing solution was prepared. The container was made by folding a laminate film of polyethylene-aluminum-cellophane-polyethylene and heat-sealing so that a cavity for retaining the processing solution was formed.

| | | | | |
|---|---|---|---|---|
| 1. | No development accelerator | | | |
| 2. | Compound of the Invention: | Aminoethylethanolamine | 0.005 | ml |
| 3. | | " | 0.01 | ml |
| 4. | | " | 0.05 | ml |
| 5. | | " | 0.1 | ml |
| 6. | | " | 0.3 | ml |
| 7. | | " | 0.5 | ml |
| 8. | | " | 1.0 | ml |

Processing Solution Formulation

| | | |
|---|---|---|
| Water | 100 | ml |
| Ascorbic Acid | 20 | mg |
| 4-Amino-3-methyl-N-ethyl-N-(β-hydroxyl)aniline Sulfate | 3.0 | g |
| 6-Nitrobenzimidazole Nitrate | 15 | mg |
| Sodium Hydroxide | 4.0 | g |
| Carboxymethyl Cellulose Sodium Salt | 3.5 | g |
| Titanium Dioxide | 3.0 | g |
| Sodium Thiosulfate (anhydrous) | 0.8 | g |
| Compound of the Invention | 0~ 1.0 | ml |

The processing composition was prepared and put into the container in the atmosphere of Freon gas (Freon 12).

The thus prepared light-sensitive element and the image-receiving element were cut into 10 × 8 cm size and the thus cut sheets were pressed to intimately adhere each other with the coated films facing each other. A 115 μ-thick, porous polyethylene terephthalate sheet containing titanium dioxide was adhered along the periphery of the image-receiving element so that it bordered the image. The aforesaid processing solution-retaining container was fixedly positioned at the leading end of the resulting composite so that the contents could be released between the light-sensitive element and the image-receiving element. Furthermore, a polyethylene terephthalate light-intercepting element of sufficient size to cover the light-sensitive surface and of a thickness of about 50 μ containing 5% by weight carbon black was adhered along the leading end of the light-sensitive element, and an ethyl acetate solution of polyvinyl acetate containing carbon black was coated at the margins of the film composite to prevent light leakage through the edges. Thus, film units as illustrated in FIGS. 2*a* and 2*b* containing the compound of the present invention in different amounts were completed.

Sensitometry was conducted by step-wise exposure of the film units through the transparent support of the light-sensitive element with the light-intercepting element moved out of the path of the light of exposure. After superposing the light-intercepting element, the film unit was passed through a pair of juxtaposed rollers to spread the processing composition in a thickness of 200 μ. The processing was continued leaving each of the 8 film units in a bright room at 25°C. The formation of the transferred dye images was observed through the support of the image-receiving layer. The reflection density of the transferred images was measured using red(R), blue(B) and green(G) filters. The results thus obtained are shown in Table 1.

TABLE 1

| Amount (ml) of the Compound of the Invention Added | | Reflection Density Dmax R | Dmax G | Dmax B | Dmin R | Dmin G | Dmin B | ΔD* R | ΔD* G | ΔD* B |
|---|---|---|---|---|---|---|---|---|---|---|
| Aminoethanolamine | 0 | 1.40 | 1.40 | 1.30 | 0.20 | 0.40 | 0.35 | 1.20 | 1.00 | 0.95 |
| " | 0.005 | 1.40 | 1.45 | 1.40 | 0.15 | 0.20 | 0.20 | 1.25 | 1.25 | 1.20 |
| " | 0.01 | 1.40 | 1.45 | 1.40 | 0.15 | 0.15 | 0.20 | 1.25 | 1.30 | 1.20 |
| " | 0.05 | 1.60 | 1.60 | 1.55 | 0.10 | 0.12 | 0.15 | 1.50 | 1.48 | 1.30 |
| " | 0.1 | 1.60 | 1.65 | 1.60 | 0.15 | 0.17 | 0.22 | 1.45 | 1.48 | 1.38 |
| " | 0.3 | 1.50 | 1.50 | 1.60 | 0.20 | 0.35 | 0.40 | 1.30 | 1.15 | 1.20 |
| "0.5 | 1.50 | 1.50 | 1.50 | 0.30 | 0.45 | 0.45 | 1.20 | 1.05 | 1.05 | |
| " | 1.0 | 1.50 | 1.60 | 1.55 | 0.40 | 0.50 | 0.55 | 1.10 | 1.10 | 1.00 |

*ΔD = Dmax − Dmin: This corresponds to the contrast of images.

As can be seen from the results of measuring the reflection density shown in Table 1, film units to which the compound of the present invention had been added in a suitable amount provided distinct images having high contrast (ΔD). Also, it can be seen that, when the compound was added in an amount greater than is suitable, the Dmin increases, resulting in a reduction in contrast.

EXAMPLE 2

Film units were prepared in the same manner as in Example 1 except for using $1.8 \times 10^{-5}$ mol/100 $cm^2$ of cyan-forming coupler, 1-hydroxy-N-[γ-(2,4-di-t-amylphenoxy)propyl]-2-naphthamide in place of the yellow-forming coupler in the third layer and in place of the magenta-forming coupler in the ninth layer contained in the light-sensitive unit. 0.1 g of each of the following compounds of the present invention was added to the processing solution, and exposure, development, processing and sensitometry were conducted in the same manner as in Example 1. The results thus obtained are shown in Table 2.

Compound 4: $NH_2CH_2CH_2NHCH_2CH_2OH$
Compound 5: $NH_2CH_2CH_2CH_2NHCH_2CH_2OH$
Compound 6: $NH_2CH_2CH_2NHCH_2CH_2CH_2OH$
Compound 13: $NH_2CH_2CH_2N(CH_3)CH_2CH_2OH$
Compound 14: $NH_2CH_2CH_2N(NH_2)CH_2CH_2OH$
Compound 16:
$NH_2CH_2CH_2N(CH_2CH_2NH_2)CH_2CH_2OH$

TABLE 2

| Compound of the Invention | Reflection Density Dmax R | G | B | Dmin R | G | B | ΔD R | G | B |
|---|---|---|---|---|---|---|---|---|---|
| None | 1.38 | 1.42 | 1.35 | 0.20 | 0.35 | 0.30 | 1.18 | 1.07 | 1.05 |
| Compound 4 | 1.48 | 1.55 | 1.50 | 0.18 | 0.30 | 0.25 | 1.30 | 1.25 | 1.25 |
| Compound 5 | 1.48 | 1.63 | 1.62 | 0.20 | 0.33 | 0.32 | 1.28 | 1.30 | 1.30 |
| Compound 6 | 1.57 | 1.59 | 1.53 | 0.25 | 0.32 | 0.28 | 1.32 | 1.27 | 1.25 |
| Compound 13 | 1.45 | 1.50 | 1.42 | 0.20 | 0.28 | 0.28 | 1.25 | 1.22 | 1.14 |
| Compound 14 | 1.57 | 1.60 | 1.60 | 0.21 | 0.30 | 0.28 | 1.36 | 1.30 | 1.32 |
| Compound 16 | 1.59 | 1.62 | 1.58 | 0.18 | 0.25 | 0.20 | 1.41 | 1.37 | 1.38 |

As can be seen from the results given in Table 2, film units to which the compounds of the invention had been added provided images having high contrast (which can be seen from the value of the ΔD).

EXAMPLE 3

Film units comprising the light-sensitive unit and the image-receiving unit described in Example 2 and the processing solution described in Example 1 containing 0.7 ml of aminoethylethanolamine as the compound of the present invention and film units not containing the compound of the present invention were prepared and subjected to similar exposure and development processing in Example 1. The reflection density of the color images transferred to the image-receiving element was measured at definite intervals of time to examine the progress of the development. The results thus obtained are shown in Table 3.

TABLE 3

| Processing Time (min) | Reflection Density Dmax R | G | B | Dmin R | G | B | ΔD R | G | B |
|---|---|---|---|---|---|---|---|---|---|
| None: | | | | | | | | | |
| 2 | 0.35 | 0.40 | 0.20 | 0.13 | 0.15 | 0.10 | 0.22 | 0.25 | 0.10 |
| 5 | 0.60 | 0.75 | 0.60 | 0.15 | 0.18 | 0.12 | 0.45 | 0.57 | 0.48 |
| 10 | 1.20 | 1.25 | 1.21 | 0.20 | 0.23 | 0.15 | 1.00 | 1.02 | 1.06 |
| Containing the Compound of the Invention: | | | | | | | | | |
| 2 | 0.65 | 0.70 | 0.45 | 0.14 | 0.17 | 0.12 | 0.51 | 0.53 | 0.33 |
| 5 | 0.90 | 1.05 | 0.75 | 0.18 | 0.19 | 0.12 | 0.72 | 0.86 | 0.63 |
| 10 | 1.50 | 1.58 | 1.50 | 0.22 | 0.25 | 0.14 | 1.28 | 1.33 | 1.36 |

As can be seen from the results shown in Table 3, film units to which the compound of the present invention had been added rapidly provided distinct images having a high contrast (ΔD) and a high density (Dmax) of color images fixed in the image-receiving layer in a definite processing time, as compared with the film units to which the compound of the present invention had not been added.

EXAMPLE 4

Light-sensitive element and image-receiving elements were prepared in the same manner as in Example 1. Six processing solutions were prepared by adding to the formulation shown in Example 1 the compound of the present invention, 2-hydroxy-1,3-diaminopropane, in an amount of 0, 0.01, 0.05, 0.2 or 1 ml. 1.5 ml of each processing solution was placed in a rupturable container and the rupturable container then positioned between the light-sensitive element and the image-receiving element. Then, each of the resulting film units was exposed and processed to spread the processing solution in the same manner as in Example 1. Sensitometry was conducted 10 minutes after the processing. The results thus obtained are shown in Table 4. Also, with the sample to which the compound of the present invention had been added in an amount of 0.2 ml, sensitometry was conducted after developing for 2,5 and 10 minutes to show the state of the progress of development.

TABLE 4

| Compound of the Invention:(ml) | Processing Time (min) | Reflection Density Dmax R | G | B | Dmin R | G | B | ΔD R | G | B |
|---|---|---|---|---|---|---|---|---|---|---|
| None | 10 | 1.20 | 1.25 | 1.21 | 0.20 | 0.23 | 0.15 | 1.00 | 1.02 | 1.06 |
| 0.01 | 10 | 1.32 | 1.37 | 1.29 | 0.23 | 0.21 | 0.18 | 1.09 | 1.16 | 1.11 |
| 0.05 | 10 | 1.42 | 1.57 | 1.39 | 0.18 | 0.19 | 0.16 | 1.24 | 1.38 | 1.23 |
| 0.25 | 2 | 0.60 | 0.65 | 0.48 | 0.09 | 0.10 | 0.07 | 0.51 | 0.55 | 0.41 |
| 0.25 | 5 | 1.05 | 0.98 | 0.85 | 0.12 | 0.15 | 0.10 | 0.93 | 0.83 | 0.75 |
| 0.25 | 10 | 1.48 | 1.48 | 1.45 | 0.20 | 0.25 | 0.18 | 1.28 | 1.33 | 1.23 |
| 1 | 10 | 1.48 | 1.62 | 1.50 | 0.30 | 0.29 | 0.21 | 1.18 | 1.33 | 1.29 |

From the results of the measurement of the reflection density shown in Table 4, it can be seen that the film units to which the compound of the present invention had been added in a suitable amount, provided images having a high Dmax and a low Dmin, i.e., had a high contrast as compared with a film unit which did not contain the compound of the invention. Also, it can be seen that, as compared with the development progress of the sample to which the compound of the present invention had not been added, shown in Example 3, Table 3, the development progress of the sample to which the compound of the present invention had been added in an amount 0.25 ml is far greater. This enables an instant photograph to be rapidly obtained. Thus, it can be seen how advantageous it is to incorporate the compound of the present invention in the light-sensitive unit.

EXAMPLE 5

Film units comprising the light-sensitive unit and the image-receiving unit described in Example 2 and the processing solution described in Example 1 containing the following compounds as the compound of the present invention and film unit not containing the compound of the present invention were prepared and subjected to similar exposure, development processing and sensitometry as described in Example 1. The results thus obtained are shown in Table 5. Each of the compounds of the present invention was added in an amount of 0.5 g.

Compound of the Invention 17: $NH_2CH_2\underset{\underset{OH}{|}}{CH}-CH_2-NH_2$ Compound of the Invention 19: $NH_2CH_2CH_2\underset{\underset{OH}{|}}{C}HCH_2CH_2NH_2$ Compound of the Invention 25: $NH_2CH_2\overset{\overset{NH_2}{|}}{\underset{\underset{OH}{|}}{C}}CH_2CH_2NH_2$ Compound of the Invention 22: $NH_2CH_2\overset{\overset{CH_2NH_2}{|}}{\underset{\underset{OH}{|}}{C}}-CH_2NH_2$ Compound of the Invention 27: $NH_2CH_2\overset{\overset{CH_2CH_2NH_2}{|}}{\underset{\underset{OH}{|}}{C}}-CH_2NH_2$

TABLE 5

| Compound of the Invention | Reflection Density Dmax R | Dmax G | Dmax B | Dmin R | Dmin G | Dmin B | ΔD R | ΔD G | ΔD B |
|---|---|---|---|---|---|---|---|---|---|
| None | 1.20 | 1.25 | 1.21 | 0.20 | 0.23 | 0.15 | 1.00 | 1.12 | 1.06 |
| 17 | 1.56 | 1.60 | 1.45 | 0.16 | 0.20 | 0.14 | 1.40 | 1.40 | 1.31 |
| 19 | 1.52 | 1.49 | 1.41 | 0.16 | 0.18 | 0.12 | 1.36 | 1.31 | 1.29 |
| 22 | 1.59 | 1.60 | 1.50 | 0.23 | 0.26 | 0.19 | 1.37 | 1.34 | 1.31 |
| 25 | 1.59 | 1.65 | 1.57 | 0.20 | 0.21 | 0.14 | 1.39 | 1.44 | 1.43 |
| 27 | 1.61 | 1.64 | 1.52 | 0.19 | 0.20 | 0.17 | 1.42 | 1.44 | 1.35 |

From the results of sensitometry shown in Table 5, it can be seen that samples to which the compound of the present invention had been added provided very contrasty images having a large ΔD value.

EXAMPLE 6

The sensitizers of the present invention were compared with conventionally known sensitizers. As samples for testing, the following were used.

Light-sensitive Element: A light-sensitive unit comprising a blue-sensitive negative-type silver halide emulsion layer (iodide content: 3.0 mol%; mean grain size: 0.8 $\mu$) formed by multi-layer-coating the first layer through the fifth layer described in Example 1, an interlayer and a positive layer containing a gold colloid and a coupler capable of releasing a diffusable yellow dye.

Processing Solution: Prepared in the same manner as in Example 1 except for changing the kind and the amount of the sensitizer to the following conventionally known sensitizers and the compound of the present invention as follows.

1. Polyethylene glycol (molecular weight: 1,500)
2. Phenidone
3. Diethanolamine
4. Hydroquinone
5. 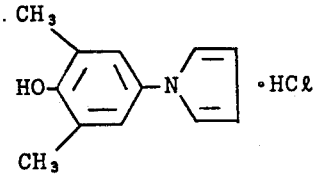

6. 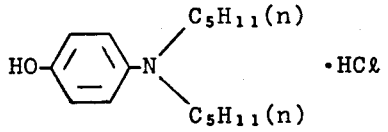

7. Hydroxylamine Hydrochloride
8. Glycine
9. Amidol
10. $NH_2C_2H_4NHC_2H_4OH$ (compound of the present invention)

Image-receiving Layer: same as in Example 1.

The thus prepared samples were used and subjected to the same sensitometry as in Example 1. The reflection density of the yellow dye transferred onto image-receiving sheet was measured through a blue filter. The results thus obtained are shown in Table 6.

TABLE 6

| Amount of the Compound added to Processing Solution (xg/100 ml) | | Reflection Density Dmax | Dmin | ΔD |
|---|---|---|---|---|
| None | | 1.86 | 0.28 | 1.58 |
| Polyethylene Glycol (MW=1500) | 0.01 | 1.75 | 0.30 | 1.45 |
| " | 0.20 | 1.76 | 0.27 | 0.49 |
| Phenidone | 0.01 | 1.65 | 0.25 | 1.40 |
| " | 0.20 | 0.92 | 0.10 | 0.82 |
| Diethanolamine | 0.01 | 1.86 | 0.29 | 1.57 |
| " | 0.20 | 1.90 | 0.30 | 1.60 |

TABLE 6-continued

| Amount of the Compound added to Processing Solution (xg/100 ml) | | Reflection Density Dmax | Dmin | ΔD |
|---|---|---|---|---|
| Hydroquinone | 0.01 | 1.70 | 0.35 | 1.35 |
| " | 0.10 | 0.89 | 0.29 | 0.60 |
| 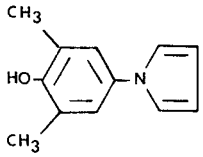 ·HCl | 0.01 | 1.10 | 0.20 | 0.90 |
| " | 0.20 | 0.25 | 0.05 | 0.20 |
| 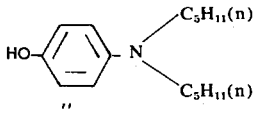 ·HCl | 0.01 | 1.61 | 0.21 | 1.40 |
| " | 0.25 | 0.27 | 0.02 | 0.25 |
| Hydroxylamine Hydrochloride | 0.01 | 1.78 | 0.28 | 1.50 |
| " | 0.25 | 1.10 | 0.30 | 0.80 |
| Glycine | 0.01 | 1.88 | 0.32 | 1.58 |
| " | 0.25 | 1.82 | 0.32 | 1.50 |
| Amidol | 0.01 | 1.47 | 0.27 | 1.20 |
| " | 0.25 | 0.32 | 0.12 | 0.30 |
| $NH_2C_2H_4NHC_2H_4OH$ (Compound of the Invention) | 0.01 | 2.10 | 0.25 | 1.85 |
| " | 0.20 | 2.12 | 0.32 | 1.80 |

As can be seen from the results shown in Table 6, compounds heretofore known as a sensitizer for use in black-and-white or ordinary systems reduced not only the Dmin but the Dmax as well and, as a result, the ΔD was reduced resulting in forming images having low contrast. Also, although the measurement of the sensitivity of the negative images showed that phenidone, hydroxylamine, glycine, amidol and the like increased the sensitivty as is known and were effective as a sensitizer for the negative layer, they provided only images having low contrast when applied to a color photographic method wherein a reversal image is formed by the dissolution-physical development as in the present invention. Thus, it can be seen that a sample without such compounds is better.

On the other hand, samples to which the compound of the present invention ($NH_2C_2H_4NHC_2H_4OH$) had been added provided very contrasty transferred images having a high Dmax. Thus, the compound of the invention was demonstrated to be an excellent sensitizer.

While the invention has been described in detail and with reference to specific embodiments thereof, it will be apparent to one skilled in the art that various changes and modifications can be made therein without departing from the spirit and scope thereof.

What is claimed is:

1. A diffusion transfer color film unit for the dissolution-physical development system, A. which comprises:

1. a light-sensitive element comprising a support having thereon at least one light-sensitive layer unit comprising
   i. a negative-type light-sensitive silver halide emulsion layer containing a ballasted compound capable of reacting with an oxidation product of an aromatic primary amino color developing agent to provide a non-diffusible compound and
   ii. an adjacent layer containing physical development nuclei and a ballasted coupler capable of reacting with an oxidation product of an aromatic primary amino color developing agent to provide a diffusible dye;
2. an image-receiving element comprising a support having thereon an image-receiving layer capable of fixing diffusible dyes released from the light-sensitive element;
3. a rupturable container which retains an alkaline processing composition and which is capable of releasing an alkaline processing composition by the action of pressure-applying members for spreading between the light-sensitive element and the image-receiving element; and
4. an aromatic primary amino color developing agent in the processing composition or a precursor thereof which provides, upon hyrolysis with the processing composition, said developing agent in the light-sensitive element, and a solvent for silver halide, and B. which is adapted to be processed, after imagewise exposure of said light-sensitive element, by spreading the processing composition as a layer between the light-sensitive element and the image-receiving element through the action of pressure-applying members, said diffusion transfer color film unit containing at least one compound represented by the following general formula (I)

$$NH_2-R_1-\overset{\overset{R_3}{|}}{N}-R_2-OH \qquad (I)$$

wherein $R_1$ and $R_2$ each represents an alkylene group having 1 to 4 carbon atoms; and $R_3$ represents a hydrogen atom, an amino group, an alkyl group having 1 to 4 carbon atoms or an aminoalkyl group having 1 to 4 carbon atoms; or represented by the following general formula (II)

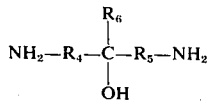

(II)

wherein $R_4$ and $R_5$ each represents an alkylene group having 1 to 4 carbon atoms; and $R_6$ represents a hydrogen atom, an amino group, an alkyl group having 1 to 4 carbon atoms or an aminoalkyl group having 1 to 4 carbon atoms.

2. The film unit as described in claim 1, wherein the compound represented by the general formula (I) or (II) is present in an amount of about 0.05 g to 3 g per liter of the processing solution.

3. The film unit as described in claim 1, wherein said solvent for silver halide is present in the processing composition and the physical development nuclei are present in a light-insensitive layer of the light-sensitive element.

4. The film unit as described in claim 3, wherein the light-sensitive element contains an acid having a pKa of higher than about 8 whose conjugate base anion becomes the solvent for the silver halide.

5. The film unit as described in claim 1, wherein at least one of said light-sensitive element and said image-receiving element contains a neutralizing layer containing a sufficient quantity of an acidic substance to neutralize the alkali from the spread processing composition to a pH at which the dye images arer stable and when said light-sensitive element contains said neutralizing layer said neutralizing layer is positioned between the support of the light-sensitive element and the light-sensitive layer and when said image-receiving layer contains said neutralizing layer said neutralizing layer is positioned between the support of the image-receiving element and the image-receiving layer.

6. The film unit as described in claim 5, wherein said neutralizing layer contains the acidic substance in an amount at least equivalent to the amount of alkali per unit area of the spread processing composition.

7. The film unit as described in claim 5, wherein when said light-sensitive element contains said neutralizing layer said neutralizing layer and the light-sensitive silver halide emulsion layer are separated from each other by a timing layer.

8. The film unit as described in claim 5, wherein when said image-receiving element contains said neutralizing layer said neutralizing layer and said image-receiving layer are separated from each other by a timing layer.

9. The film unit as described in claim 1 including a light-intercepting layer, which, during processing of the film unit outside a camera, can protect the light-sensitive silver halide emulsion layer from ambient light and can be easily removed after processing, on the opposite surface of the transparent support of the light-sensitive element to the silver halide emulsion layer side.

10. The film unit as described in claim 1 including a light-intercepting layer, which can protect the light-sensitive silver halide emulsion layer from ambient light during processing of the film unit outside a camera and which loses its light-intercepting ability by after-processing, between the transparent support of the light-sensitive element and the light-sensitive silver halide emulsion layer.

11. The film unit as described in claim 10, wherein said light-intercepting layer contains black colloidal silver.

12. The film unit as described in claim 1, including a light-intercepting element which can cover the opposite surface of the light-sensitive element to the emulsion layer side after the imagewise exposure thereof through the transparent support of the light-sensitive element and before the action of pressure-applying members so as to protect the light-sensitive silver halide emulsion layer from ambient light during processing of the film unit in a bright place outside a camera.

13. The film unit as described in claim 12, including a light-intercepting element having an opening to receive the exposed light-sensitive element and being bound to the image-receiving element at the margins of the image-receiving element with the image-receiving layer directed toward the inside.

14. The film unit as described in claim 1, wherein said aromatic primary amino developing agent is a p-phenylenediamine compound.

15. The film unit as described in claim 1, wherein said ballasted compound in said negative-type silver halide emulsion is a compound containing both a coupler nucleus residue capable of coupling with an oxidation product of the aromatic primary amino color developing agent to form a ballasted compound and a hydrophobic residue containing 8 or more carbon atoms.

16. The film unit is described in claim 1, wherein the ballasted coupler capable of providing a diffusible dye is a compound containing (i) a coupler nucleus residue capable of reacting with the oxidation product of an aromatic primary amino color developing agent to form a dye structure and having at least one water-solubilizing group at the non-coupling position of said coupler nucleus residue, and (ii) a substituent containing a hydrophobic residue having 8 or more carbon atoms at the coupling position of said coupler nucleus residue.

17. The film unit as described in claim 16, wherein said water-solubilizing group is a sulfo group, a carboxy group, or a sulfonamido group.

18. The film unit as described in claim 1, including an $\alpha$-acylacetanilide compound as a yellow dye-providing coupler.

19. The film unit as described in claim 1, including a 5-pyrazolone compound as a magenta dye-providing coupler.

20. The film unit as described in claim 1, including a phenol compound or an $\alpha$-naphthol compound as a cyan dye-providing coupler.

21. The film unit as described in claim 1, wherein the support of said image-receiving element is transparent.

22. The film unit as described in claim 21, including a processing composition permeable light-intercepting layer containing a light absorbent, in a sufficient quantity to protect the light-sensitive silver halide emulsion layer from ambient light during processing of the film unit outside a camera, covering the opposite surface of the light-sensitive element to the support side.

23. The film unit as described in claim 22, wherein a substantial portion of the light-reflecting substance is contained in the processing composition, said light-reflecting substance being present in a quantity necessary for masking, during processing the light-intercepting layer of the light-sensitive element and for forming a white background for the transferred dye images.

24. The film unit as described in claim 22, including a processing composition permeable layer containing a light-reflecting substance in a quantity necessary for masking, during processing, the light-intercepting layer of the light-sensitive element and for forming a white background for the tranferred dye images covering the surface of said image-receiving layer.

25. The film unit as described in claim 24, wherein said processing composition contains a light absorbent in a quantity necessary for protecting the light-sensitive silver halide emulsion layer from ambient light during processing of the film unit outside a camera.

26. The film unit as described in claim 1, including a light-reflecting substance, necessary for forming a white background for the transferred dye images, in the support of the image-receiving layer or between the image-receiving layer and the support of the image-receiving layer.

27. The film unit as described in claim 1, including a delaminating layer between the surface of the light-sensitive silver halide emulsion layer farthest from the support of the light-sensitive element and the opposite of the image-receiving element to the support side, which delaminating layer facilitates the separation of the light-sensitive element and the image-receiving element from each other after processing.

* * * * *